US012098537B2

(12) United States Patent
Dragan

(10) Patent No.: US 12,098,537 B2
(45) Date of Patent: Sep. 24, 2024

(54) MODULAR CLEARSPAN BUILDING, AND MODULAR BUILDING SECTIONS AND CONSTRUCTION METHODS THEREFOR

(71) Applicant: Simon Dragan, Fort Wayne, IN (US)

(72) Inventor: Simon Dragan, Fort Wayne, IN (US)

( * ) Notice: Subject to any disclaimer, the term of this patent is extended or adjusted under 35 U.S.C. 154(b) by 0 days.

(21) Appl. No.: 15/634,763

(22) Filed: Jun. 27, 2017

(65) Prior Publication Data

US 2017/0370091 A1 Dec. 28, 2017

Related U.S. Application Data

(60) Provisional application No. 62/354,865, filed on Jun. 27, 2016.

(51) Int. Cl.

| | |
|---|---|
| ***E04B 1/24*** | (2006.01) |
| ***E04B 1/342*** | (2006.01) |
| ***E04B 1/344*** | (2006.01) |
| ***E04B 1/348*** | (2006.01) |
| ***E04B 1/35*** | (2006.01) |

(Continued)

(52) U.S. Cl.

CPC ..... *E04B 1/3483* (2013.01); *E04B 1/24* (2013.01); *E04B 1/342* (2013.01); *E04B 1/3445* (2013.01); *E04B 1/3447* (2013.01); *E04B 1/3511* (2013.01); *E04B 1/3533* (2013.01); *E04B 7/022* (2013.01); *E04B 7/04* (2013.01); *E04B 1/34317* (2023.08); *E04B 7/163* (2013.01)

(58) Field of Classification Search

CPC ..... E04B 2001/343; E04B 1/34336; E04B 1/34357; E04B 1/34368; E04B 1/34373; E04B 1/34384; E04B 1/346

See application file for complete search history.

(56) References Cited

U.S. PATENT DOCUMENTS 1,032,284 A * 7/1912 Holland ..... E04B 1/3447 52/561
2,155,876 A * 4/1939 Stout ..... B60P 3/34 135/96

(Continued)

FOREIGN PATENT DOCUMENTS

WO 2011050124 A2 4/2011

OTHER PUBLICATIONS

International Search Report and Written Opinion in PCT/US17/39512, Sep. 21, 2017.

*Primary Examiner* — Phi D A
(74) *Attorney, Agent, or Firm* — Michael D. Smith

(57) ABSTRACT

A modular building section defining the roof and opposing walls of a modular clearspan building. The building section includes a roof portion extending in a longitudinal direction between opposite first and second ends, and a pair of first and second legs, each leg pivotally attached about a pivot axis to the roof portion proximate a roof portion end. Each of the first and second legs has a stowed position in which the leg generally extends in the longitudinal direction and is in superposition with the roof portion, and an expanded position in which the leg depends from the roof portion and generally extends perpendicularly to the longitudinal direction. The legs are moveable independently of each other from their respective stowed positions to their respective expanded positions under the influence of gravity during lifting of the roof portion. Also disclosed are methods for constructing a modular clearspan building.

18 Claims, 21 Drawing Sheets

(51) Int. Cl.

| | |
|---|---|
| ***E04B 7/02*** | (2006.01) |
| ***E04B 7/04*** | (2006.01) |
| *E04B 1/343* | (2006.01) |
| *E04B 7/16* | (2006.01) |

(56) References Cited

U.S. PATENT DOCUMENTS 2,762,084 A * 9/1956 Singer ..... A01K 31/00 52/93.2
2,765,499 A * 10/1956 Couse ..... E04B 1/3442 296/176
3,296,752 A * 1/1967 Philp ..... E04B 1/3447 52/294
3,712,006 A 1/1973 Bea
3,863,419 A * 2/1975 Hendrich ..... E04B 7/18 52/745.14
3,968,618 A 7/1976 Johnson
3,971,185 A * 7/1976 Hendrich ..... E04B 1/3447 52/745.14
4,170,852 A * 10/1979 Danis, Jr. ..... E04B 1/3441 52/641
4,219,982 A * 9/1980 Hart ..... E04B 1/3447 52/641
4,242,845 A 1/1981 Osborne, Sr.
4,479,333 A 10/1984 Hendrich
5,107,639 A * 4/1992 Morin ..... E04B 1/3445 220/6
5,461,832 A 10/1995 Smith
7,464,502 B2 * 12/2008 Sardi Herrera ..... E04H 9/028 52/79.5
8,991,105 B2 3/2015 Harvey
2007/0113488 A1 * 5/2007 Wilson ..... E04B 1/344 52/79.5
2013/0104782 A1 5/2013 Rogers et al.
2013/0192147 A1 * 8/2013 Schaffert ..... E04B 1/3445 52/79.5
2015/0121776 A1 5/2015 Peterson et al.

* cited by examiner 18
29
28
12
12
12

MODULAR CLEARSPAN BUILDING, AND MODULAR BUILDING SECTIONS AND CONSTRUCTION METHODS THEREFOR

PRIORITY CLAIM AND CROSS-REFERENCE TO RELATED APPLICATION(S)

This application claims priority to U.S. Provisional Patent Application Ser. No. 62/354,865 filed Jun. 27, 2016.

BACKGROUND

1. Field of the Invention

The present invention relates to modular buildings and, particularly, to modular building sections and techniques for constructing clearspan buildings of the type immovably erected on a construction site.

2. Description of the Related Art

Modular construction utilizes individual, discrete building sections that are manufactured offsite, such as in a factory, and delivered to a construction site for final construction of the building. For example, individual wall sections may be manufactured at a factory and driven, via tractor trailers, to a construction site to be assembled to form a complete building. Alternatively, individual sections of a house, such as a living room or kitchen, may be assembled offsite and delivered to a construction site for assembly into a complete house.

Due to size and structural constraints, clearspan buildings, such as gymnasiums or auditoriums, which generally require high ceilings and large open spaces are difficult to construct modularly. Specifically, transporting large sections of such a building, such as a portion of the wall and roof, to a construction site is difficult. As a result, clearspan buildings are often manufactured using traditional on-site construction methods, or by only partially taking advantage of modular building techniques, with some of the potential benefits of such techniques being lost because of the roof and the walls being manufactured and shipped separately.

Moreover, when items intended to be newly housed by a clearspan building are already on the future building site, their removal from the construction site is often necessary during building construction. Such items may include inventory, vehicles, equipment, etc., which may be stored or in use on the planned building's floor space. This floor space may, for example, be defined by a concrete pad prepared in anticipation of the building itself being later added onto the pad. Furthermore, a convenient space may be unavailable for temporarily relocating those items during building construction. Regardless, temporary removal of such items during the construction period can be time-consuming, cost-prohibitive, and interrupt business operations. Therefore, it would be desirable to construct a modular clearspan building without necessitating removal from the construction site of items the building is intended to house.

It would also be desirable to incorporate as many of the completed building's structural and operational features as is practicable, into the modular clearspan building sections as manufactured and shipped. Doing so can avoid scheduling delays and costs associated with incorporating such features subsequent to arrival or installation of the building sections at the construction site, and allows the building to be more easily and immediately completed.

SUMMARY

In addition to facilitating modular construction of buildings or rooms having high ceilings and defining large open spaces, a modular clearspan building according to the present disclosure beneficially provides modular building sections and techniques that address the above-mentioned issues.

The invention includes, in one form thereof, a modular building section configured to have an installed state at a construction site in which the building section defines the roof and opposing walls of an immovable modular clearspan building erected on the construction site. The building section includes a roof portion extending in a longitudinal direction between opposite first and second ends, and a pair of first and second legs. Each of the first and second legs has an upper end and a lower end. The first leg is pivotally attached about a first pivot axis to the roof portion proximate the roof portion first end, and the second leg is pivotally attached about a second pivot axis to the roof portion proximate the roof portion second end. The first and second pivot axes are parallel to each other and spaced in the longitudinal direction. Each of the first and second legs has a stowed position in which the leg extends generally in the longitudinal direction and is in vertical superposition with the roof portion, and an expanded position in which the leg depends from the roof portion and extends generally perpendicularly to the longitudinal direction. The first and second legs are moveable independently of each other from their respective stowed positions to their respective expanded positions under the influence of gravity during lifting of the roof portion with neither the lower end of the first leg nor the lower end of the second leg retained to the construction site, and the building section is capable of unrestrained movement relative to the construction site with the first and second legs in their expanded positions.

In some embodiments of the modular building section, the roof portion is substantially rigid between its opposite first and second ends, and in their stowed positions the first leg and the second leg are both disposed beneath the roof portion.

In some embodiments of the modular building section, the first leg and the second leg in their stowed positions are substantially co-planar.

In some embodiments of the modular building section, each leg has a free end at which the respective leg lower end terminates, and the distance between the first or second pivot axis of the roof portion and the free end of the first or second leg, respectively, is no greater than one half the distance between the first and second pivot axes of the roof portion.

In some embodiments of the modular building section, the roof portion is articulable between its opposite first and second ends and includes a pair of roof sections pivotally connected to each other about a roof axis. The building section is adapted for selectively assuming, with the first and second legs in their stowed positions, a roof portion extended condition in which the first and second legs are disposed beneath the roof portion, and a folded configuration in which the pivotally connected roof sections are vertically superposed. The distance the roof portion extends in the longitudinal direction in the folded configuration is approximately one-half the distance that the roof portion extends in the longitudinal direction in the building section installed state, and the length of the building section in the folded configuration is comparatively reduced. Consequently, transportation or storage of the modular building section can be better accommodated.

In some embodiments of the modular building section, the roof portion is supported proximate the roof axis during lifting of the roof portion, and in the building section installed state the pivotally connected roof sections define a roof portion apex along the roof axis.

In some embodiments of the modular building section, the modular building section has an expanded state in which the first and second legs are in their expanded positions, and further includes a pair of expanding flanges. Each of the pair of expanding flanges is disposed proximate to either the roof portion first end or the roof portion second end, and the roof portion and the respective first or second leg are engageable through one of the pair of expanding flanges. Each expanding flange is biased into an open position in which movement of the respective first or second leg from its expanded position towards its stowed position is prevented through abutting engagement of the expanding flange, and each expanding flange is moveable from its open position through sliding engagement of the expanding flange into a depressed position in which movement of the respective first or second leg into its expanded position is permitted. Consequently, building section is retained in the expanded state.

In some embodiments of the modular building section, each expanding flange is pivotally connected to the roof portion, and is adapted to have abutting engagement and sliding engagement with the respective first or second leg.

In some embodiments of the modular building section, each expanding flange has a free edge abuttingly engageable with the respective first or second leg in the leg expanded position.

In some embodiments of the modular building section, each first or second leg is pivotally attached to the roof portion at a location between the leg upper and lower ends, and the expanding flange abuttingly engages a portion of the respective first or second leg between the leg upper end and the pivot axis.

In some embodiments of the modular building section, with the modular building section in an expanded state, each of the first leg and the second leg has a fully expanded position into which the first or second leg is secured relative to the roof portion.

Another embodiment takes the form of a modular clearspan building including at least one aforementioned modular building section in an installed state.

In some embodiments of the modular clearspan building, the at least one modular building section has lateral edges, and the modular clearspan building includes a plurality of laterally adjacent modular building sections in an installed state, the plurality of modular building sections interconnected along juxtaposed lateral edges thereof.

Another embodiment takes the form of an aforementioned modular building section wherein, prior to the building section being in an installed state, the first and second legs includes substantially finished wall portions of a modular clearspan building.

In some embodiments of the modular building section, the building section is manufactured and configured for transportation to a construction site with the roof portion and the first and second legs defining substantially finished roof and wall portions, respectively, of a completed modular clearspan building.

In some embodiments of the modular building section, the roof portion and/or wall portions of the building section as delivered to a construction site include structural and/or operational features of a completed modular clearspan building.

In some embodiments of the modular building section, the structural and/or operational features are defined by componentry of the building section as delivered to a construction site and are selected from the group consisting of: interior siding, exterior siding, insulation, finished doors, windows, window trim, receptacles for part of an electrical system, wiring for part of an electrical system, fixtures for part of an electrical system, pipes for part of a plumbing system, fittings for part of a plumbing system, sprinkler system components, ducts for part of an HVAC system, registers for part of an HVAC system, and lighting system components.

In some embodiments of the modular building section, the modular building section includes a pair of ground-engaging wheels at least temporarily attached to and supporting the lower ends of the first and second legs during lifting of the roof portion, whereby dragging contact of the lower ends of the first and second legs on the ground during lifting of the roof portion is prevented.

The invention also includes, in another form thereof, a method for constructing a modular clearspan building including the steps of: lifting a roof portion of a modular building section; allowing a pair of legs attached to the roof portion to pivotally move relative to the roof portion about parallel pivot axes independently of each other under the influence of gravity during the step of lifting, from substantially stowed positions beneath and substantially parallel with the roof portion to expanded positions in which the legs depend from the roof portion; slidably engaging an expanding flange pivotally connected to the roof portion with an upper portion of each respective leg during pivotal movement of the leg to move the expanding flange against a biasing force from an open position to a depressed position with the leg upper end; moving each leg upper end past a free end of the respective expanding flange in its depressed position and into an expanded position and allowing the biased expanding flange to return to an open position; and automatically locking each leg in its respective expanded position by facilitating abutting engagement between the respective expanding flange free end in its open position and the leg upper end.

The invention also includes, in yet another form thereof, a method for constructing a modular clearspan building, including the steps of: providing at a construction site a plurality of modular building sections, each building section having a roof portion and pivotally attached legs defining substantially finished roof and wall portions, respectively, of a completed modular clearspan building, each building section including componentry defining structural and/or operational features of the completed clearspan building; lifting the roof portion of a first modular building section of the plurality of modular building sections; allowing a pair of legs attached to the roof portion of the first modular building section to pivotally move relative to the roof portion about parallel pivot axes independently of each other under the influence of gravity during the step of lifting, from substantially stowed positions beneath and substantially parallel with the roof portion to expanded positions in which the legs depend from the roof portion and define opposing walls of the completed clearspan building; installing the first building section by securing it into its intended position on the construction site; lifting the roof portion of a second modular building section of the plurality of modular building sections; allowing a pair of legs attached to the roof portion of the second modular building section to pivotally move relative to the roof portion about parallel pivot axes independently of each other under the influence of gravity during the step of lifting, from substantially stowed positions beneath and substantially parallel with the roof portion to expanded positions in which the legs depend from the roof portion and define opposing walls of the completed clearspan building; installing the second building section by securing it into its intended position on the construction site adjacent the first building section; and securing the first and second building sections together.

In some embodiments of the method for constructing a modular clearspan building, the method also includes the step of interconnecting at least some componentry of the first and second building sections that define structural and/or operational features of the completed clearspan building.

BRIEF DESCRIPTION OF THE DRAWINGS

The various objects, features and attendant advantages of the present invention will become fully appreciated as the same becomes better understood when considered in conjunction with the accompanying drawings. Although the drawings represent embodiments of the disclosed apparatus or system, the drawings are not necessarily to scale or to the same scale and certain features may be exaggerated or omitted in order to better illustrate and explain the present disclosure. Moreover, in any accompanying drawings that show sectional views, cross-hatching of various sectional elements may have been omitted for clarity. It is to be understood that this omission of cross-hatching is for the purpose of clarity in illustration only.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF EXEMPLARY EMBODIMENT(S)

Figure 1:
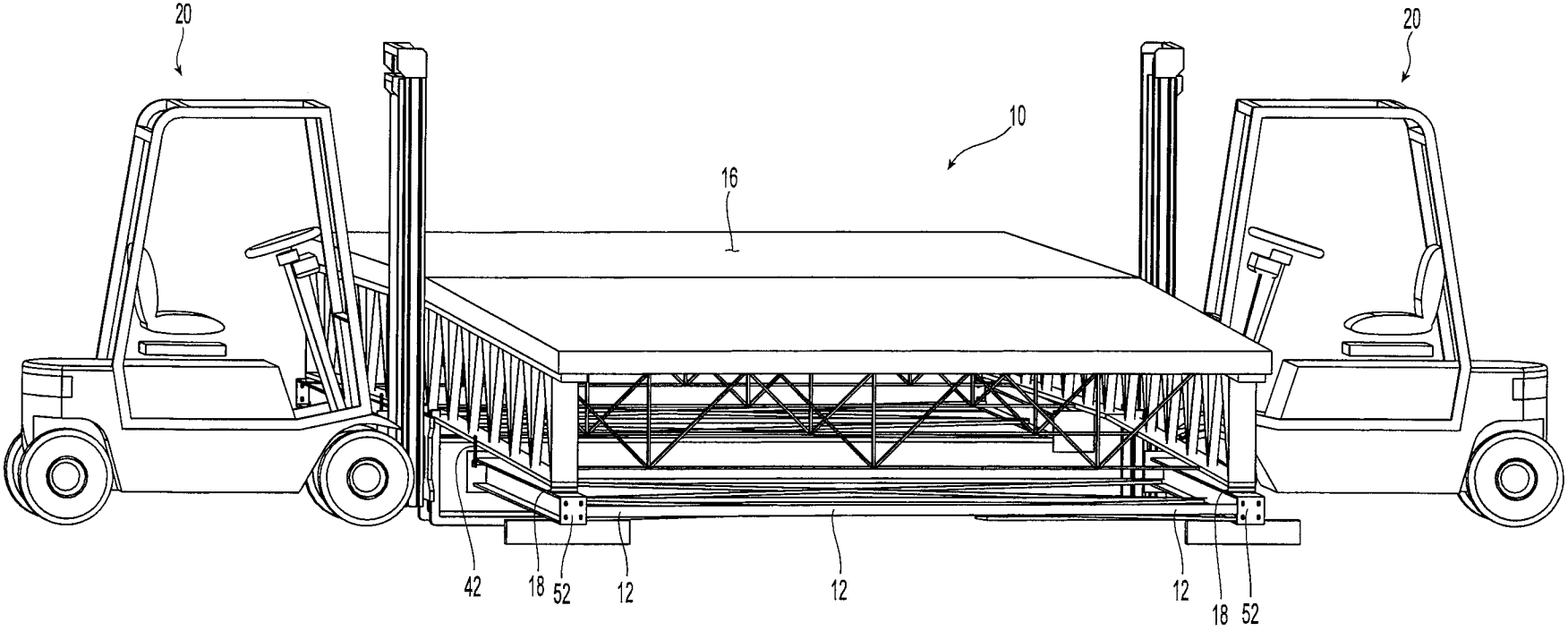
FIG. 1 is a perspective view of a modular building section according to a first exemplary embodiment according to the present disclosure.

The invention is adaptable to various modifications and alternative forms, and the specific embodiments thereof shown by way of example in the drawings are herein described in detail. The exemplary embodiments of the present disclosure are chosen and described so that others skilled in the art may appreciate and understand the principles and practices of the present disclosure. It should be understood, however, that the drawings and detailed description are not intended to limit the invention to the particular forms disclosed, but on the contrary, the intention is to cover all modifications, equivalents and alternatives falling within the spirit and scope of the present invention as defined by the appended claims.

In the exemplary embodiments described herein, a plurality of individual modular building sections is to be provided and connected together at a construction site to form a modular clearspan building. Some modular building section embodiments according to the present disclosure are manufactured and shipped with their roof portions providing a finished roof. The roofs of some such embodiments include roofing material, such as a continuous sheet of rubberized material, which extends over and is adhered to planar roof deck portions. Each roof deck portion may include a base layer of corrugated sheet metal affixed to the supporting rafters. Atop the corrugated sheet metal base layer is a first layer of wooden fiberboard sheet, atop which is a layer of 4-inch-thick structural foam board. The roof decks of building section embodiments for use in modular clearspan buildings to be constructed in high wind regions preferably include a second layer of wooden fiberboard sheets secured atop the foam board. These layers are surrounded by a 2×6-inch wooden frame across which the above-mentioned roofing material extends between the eaves at opposite ends of the roof portion. Modular building sections manufactured and shipped with finished roofs will define narrow gaps therebetween after being installed. Each gap is sealably covered with a continuous strip of roofing material that overlaps and is adhered to the roofs of adjacent building sections near their lateral edges, with the strip preferably extending the entire length of the gap.

Each building section according to the various embodiments herein described includes a roof portion including rafters which support a roof that, in some embodiments, is a roof substantially as described above. Each building section embodiment herein described also includes a pair of opposing, foldable legs pivotably connected to the roof portion near each longitudinal end of the building section. Each leg generally extends laterally the width of its building section and is pivotably connected to rafters that define part of the roof portion structure. The rafters support the roof of the building section, and are pivotably coupled to the legs at pivot points located near the eaves.

Figure 2:
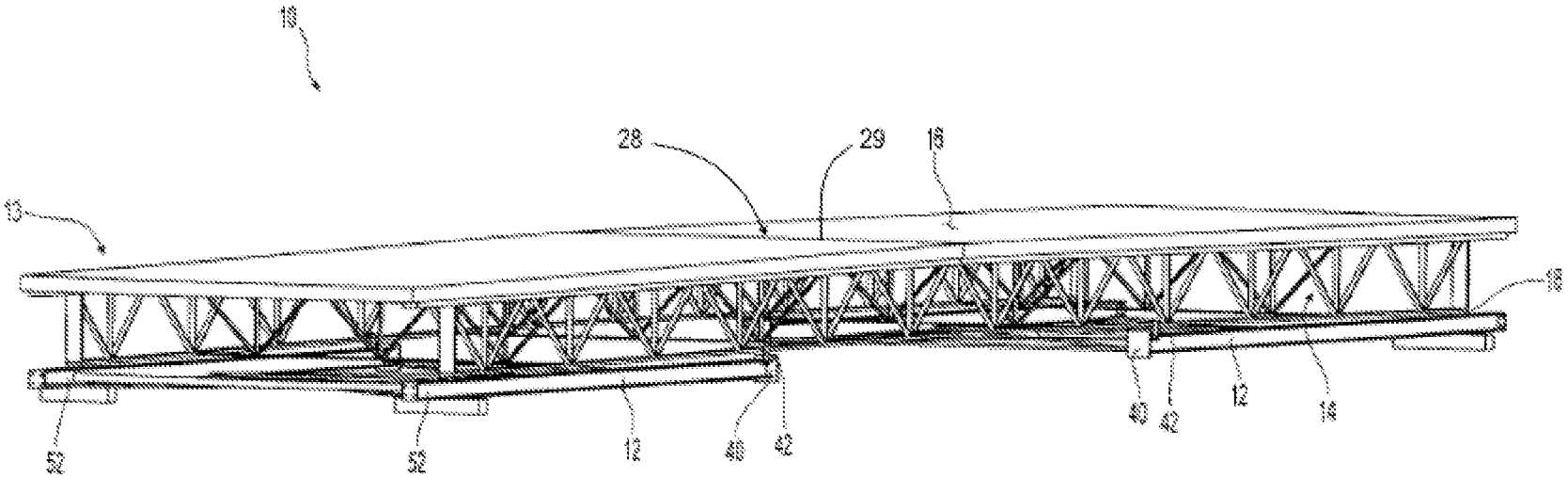
FIG. 2 is a perspective view of the building section of FIG. 1.

Referring to FIG. 1, a first exemplary building section embodiment manufactured in accordance with the present disclosure is shown and indicated generally by reference numeral 10. Building section 10 is one of a plurality of modular building sections that are adjacently installed laterally side-by-side and connected to one another to form the roof and wall structure of a modular clearspan building. In FIGS. 1 and 2, building section 10 is shown in a collapsed state in which its opposing pair of legs 12 is folded beneath substantially rigid roof portion 13 in their stowed positions. Legs 12 are pivotally attached to rafters 14 of roof portion 13, which support roof 16 of building section 10 and render roof portion 13 substantially rigid. At each end of elongate roof portion 13, legs 12 are pivotally attached to rafters 14 at laterally spaced pivot points 18, through which a pivot axis 19 extends. As noted below, building section 10 has a perpetual roof portion extended condition, and, referring to FIGS. 2-7, in its roof portion extended condition the proximity between pivot points 18, and thus between their pivot axes 19, is fixed by rigid roof portion 13 irrespective of the positions of legs 12. Hence, the proximity between axes 19 is limited by roof portion 13.

By rotating legs 12 of building section 10 inwardly about the parallel pivot axes 19, legs 12 are folded into their stowed positions wherein their interior sides interface the interior side of roof portion 13. In their stowed positions, legs 12 lie beneath and are substantially parallel with roof portion 13. The exterior side of roof portion 13 defines roof 16 of building section 10. Roof 16 has roof ridge 28 that extends in directions along roof axis 29, which is generally parallel with pivot axes 19 and is generally centered therebetween, as best shown in FIG. 2. As shown, the roof portion continuously extends in longitudinal directions across centrally-located roof axis 29. The pitch of roof 16 (e.g., ¼ inch per foot) provides a roof portion 13 that is generally flat. Roof portion 13 is also elongate (e.g., usually at least 34 feet and up to a transportation limited maximum of 80 feet) and generally narrow (e.g., up to a transportation limited width of 16½ feet).

As known to a person of ordinary skill in the relevant art, in the field of plane geometry a "complete angle" measures 360°, a "straight angle" measures 180°, and a "reflex angle" measures between 180° and 360°; relative to two intersecting lines that lie in the two-dimensional plane, an "included angle" about the point of intersection extends between the lines and about the point of intersection; and, about the point of intersection, the sum of the included angle and the reflex angle is a complete angle. Hence, an included angle extends between 0° and 180°. Included angles θ of the exemplary embodiments described herein are within the range of 0° to 180°.

Figure 7:
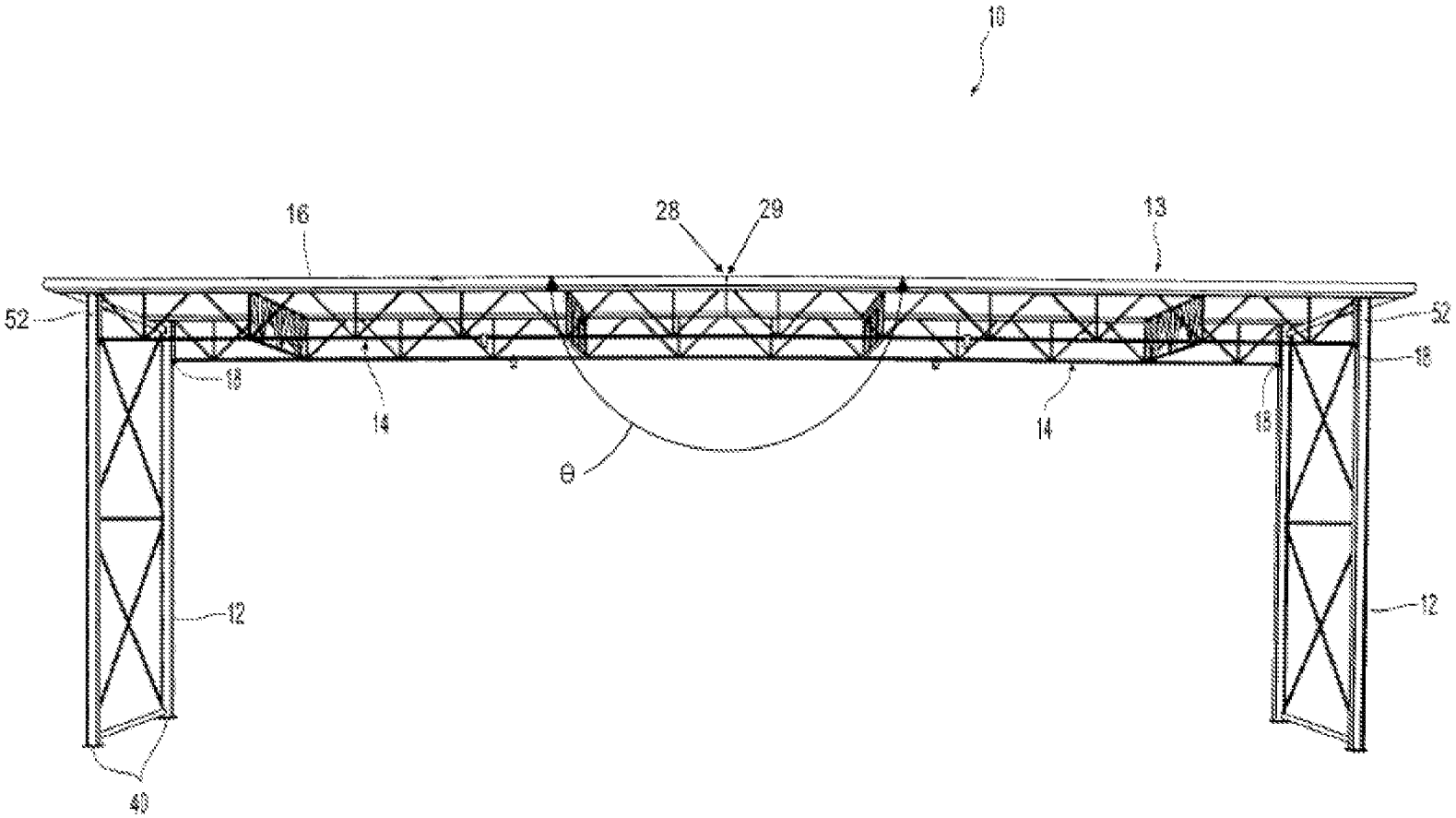

As also known to a person of ordinary skill in the relevant art, the two-dimensional plane geometry scenario is readily adapted to the three-dimensional solid geometry scenario in which the two above-mentioned intersecting lines respectively lie in two planes which extend perpendicularly relative to the above-mentioned two-dimensional plane, and the above-mentioned point of intersection is disposed along an axis normal to the two-dimensional plane, and about which axis included angle θ is measured. In building section 10, included angle θ of roof portion 13 is measured about roof axis 29, along which roof ridge 28 extends, as best shown in FIG. 7. Because roof portion 13 of building section 10 is substantially rigid, the value of included angle θ is fixed at selfsame minimal and maximal values.

Each leg 12 has a lower end at which is located leg free end 40. The distance between free end 40 of each leg 12 and its pivot axis 19 is no greater than one half the distance between the two pivot axes 19 of roof portion 13, so that both legs 12 of a building section 10 substantially lie in a plane when they are folded into their stowed positions. Legs 12 are secured to rafters 14 with removable brackets 42 that retain the legs in their stowed positions for storage and shipping of building section 10. With legs 12 in their stowed positions, each individual building section 10 has a substantially flat, thin profile that allows for a plurality of individual building sections 10 to be vertically superposed when loaded onto a trailer for transport via known tractor-trailer rigs.

Figure 3:
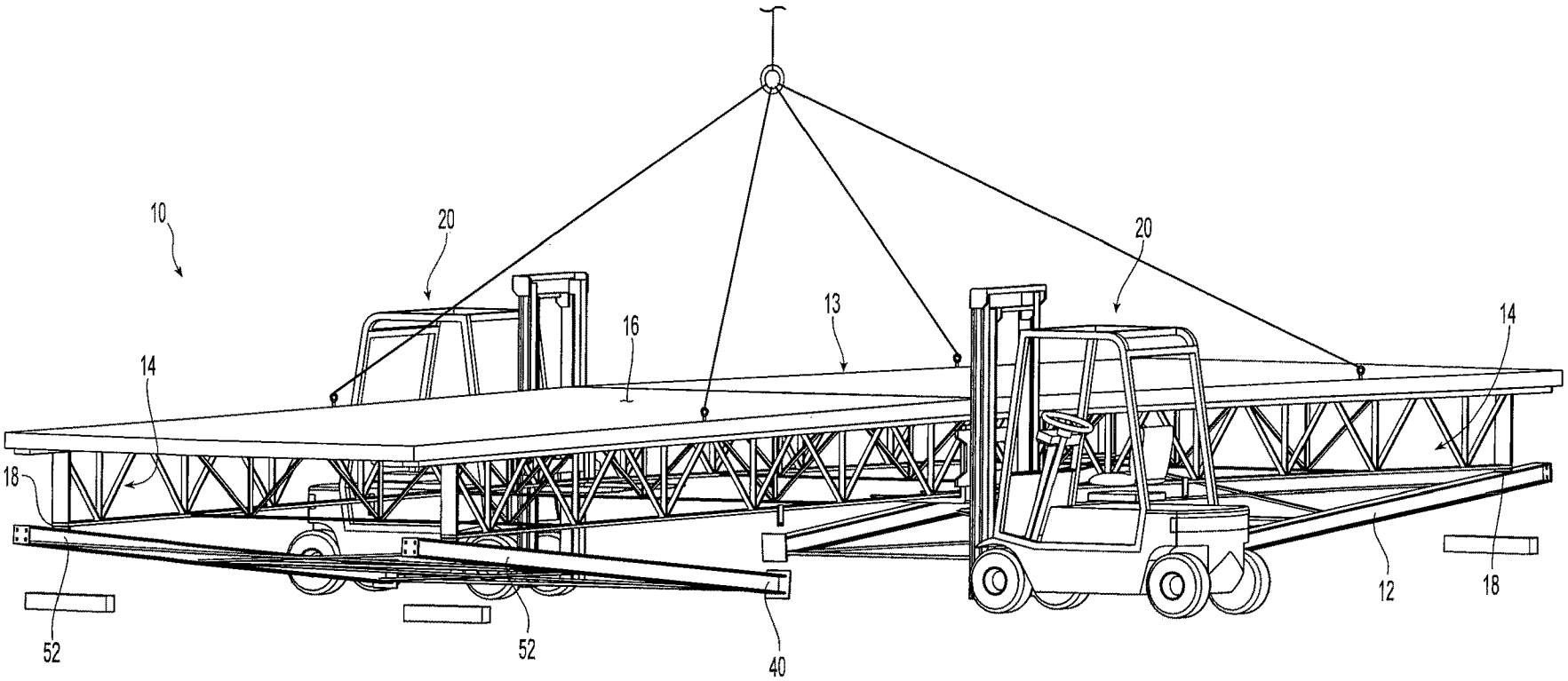
FIGS. 3-7 are perspective views depicting various steps in an exemplary process of erecting the building section of FIGS. 1 and 2.

During construction, legs 12 of building section 10 are unsecured from their stowed positions by removing brackets 42, and are unfolded downwardly, away from the interior side of roof portion 13, by allowing legs 12 to rotate about their pivot axes 19 as roof portion 13 is raised, as by forklifts 20 or a crane (not shown) through attached cables, as shown in FIG. 3. During elevation of roof portion 13, legs 12 move downwardly about pivot points 18 independently of each other from their respective stowed positions to their respective expanded positions under the influence of gravity as the roof portion is lifted, as seen in the progression shown in FIGS. 2 to 6, sequentially. Building section 10 has a perpetual roof portion extended condition owing to its legs 12 being disposed at all times beneath its rigid roof portion 13. As shown, the movements of legs 12 from their stowed positions to their expanded positions is accomplished with the lower end of neither leg 12 retained to the construction site. Consequently, building section 10 is capable of unrestrained movement over the construction site with legs 12 in their expanded positions. Moreover, as clearly shown in the embodiment depicted in FIGS. 2-7, with roof portion 13 disposed above both of legs 12, the proximity (i.e., nearness) of leg pivot axes 19 to each other is limited by roof portion 13 regardless of the positions of legs 12.

Figure 4:
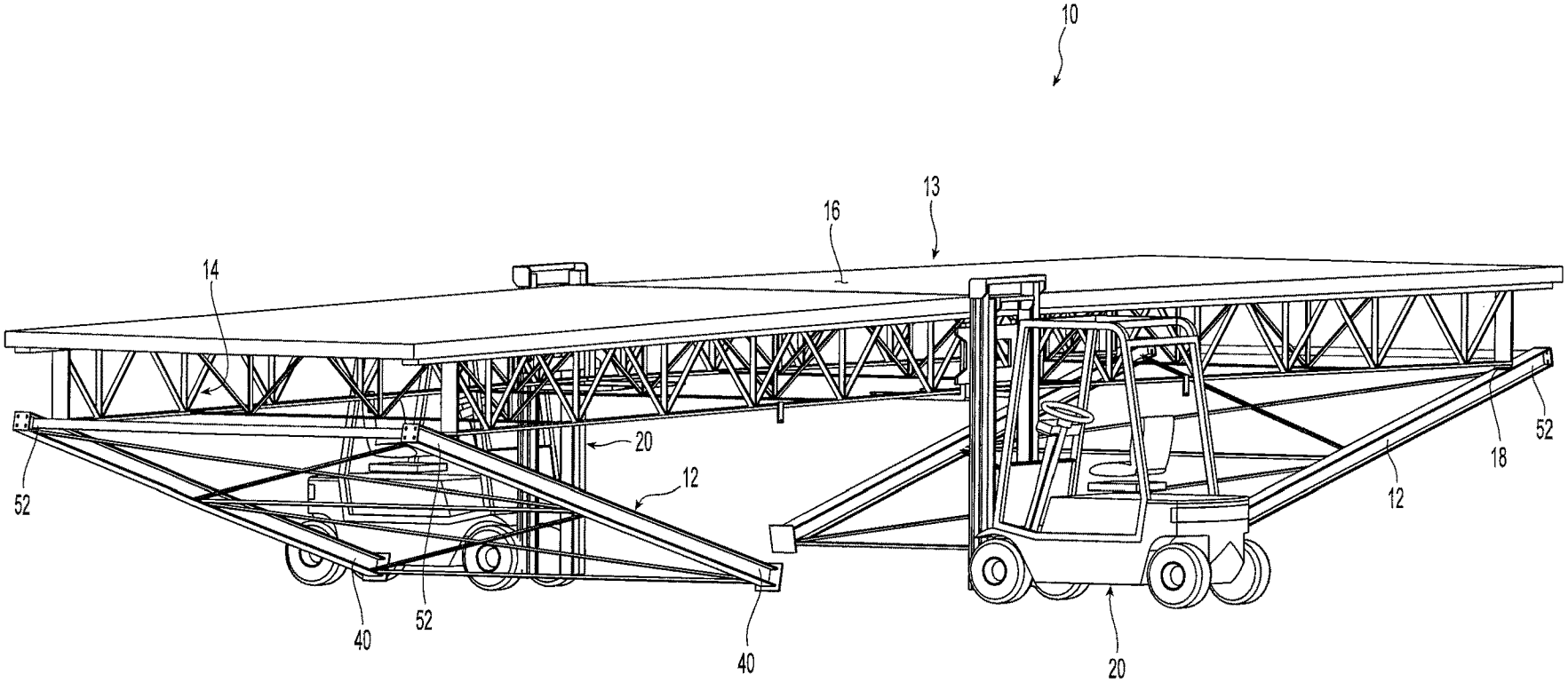
Figure 5:
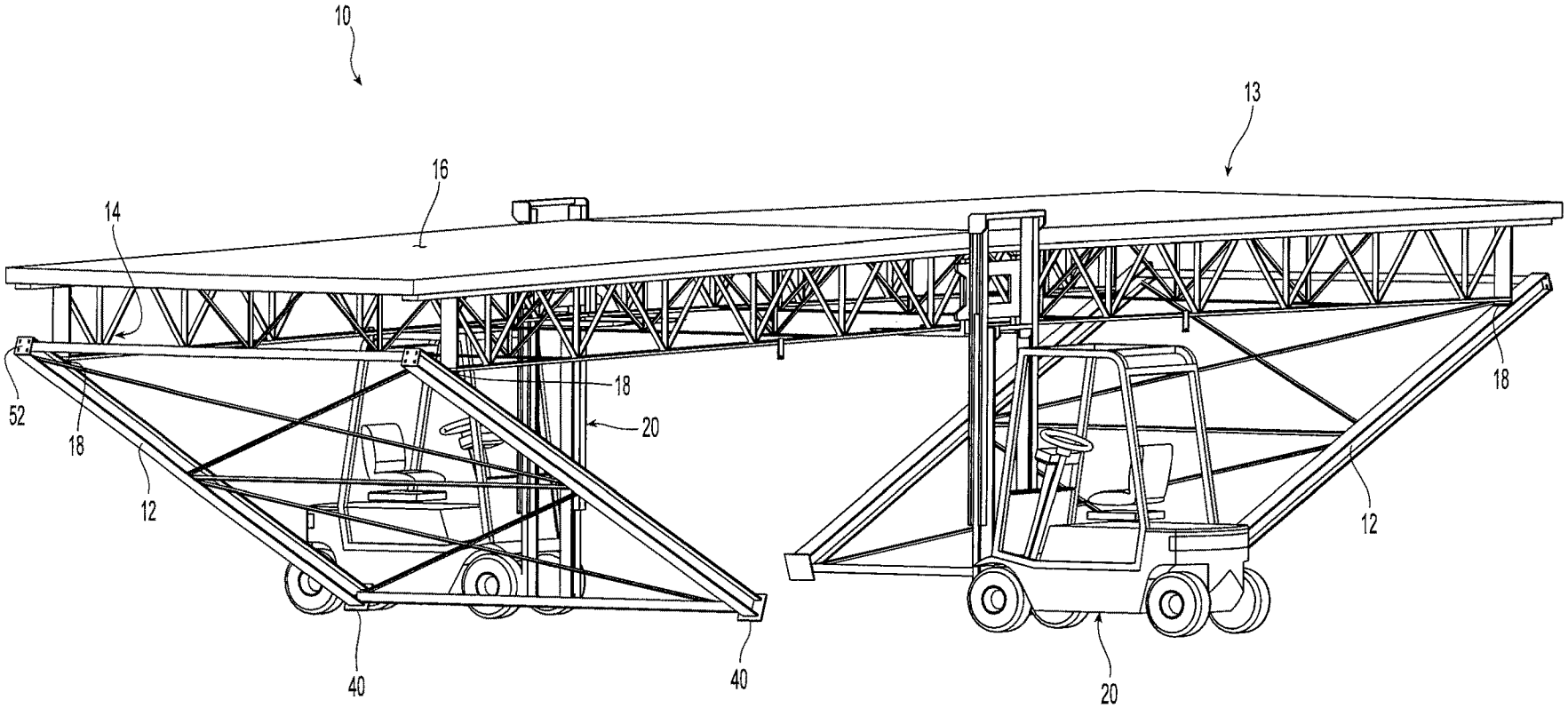
Figure 6:
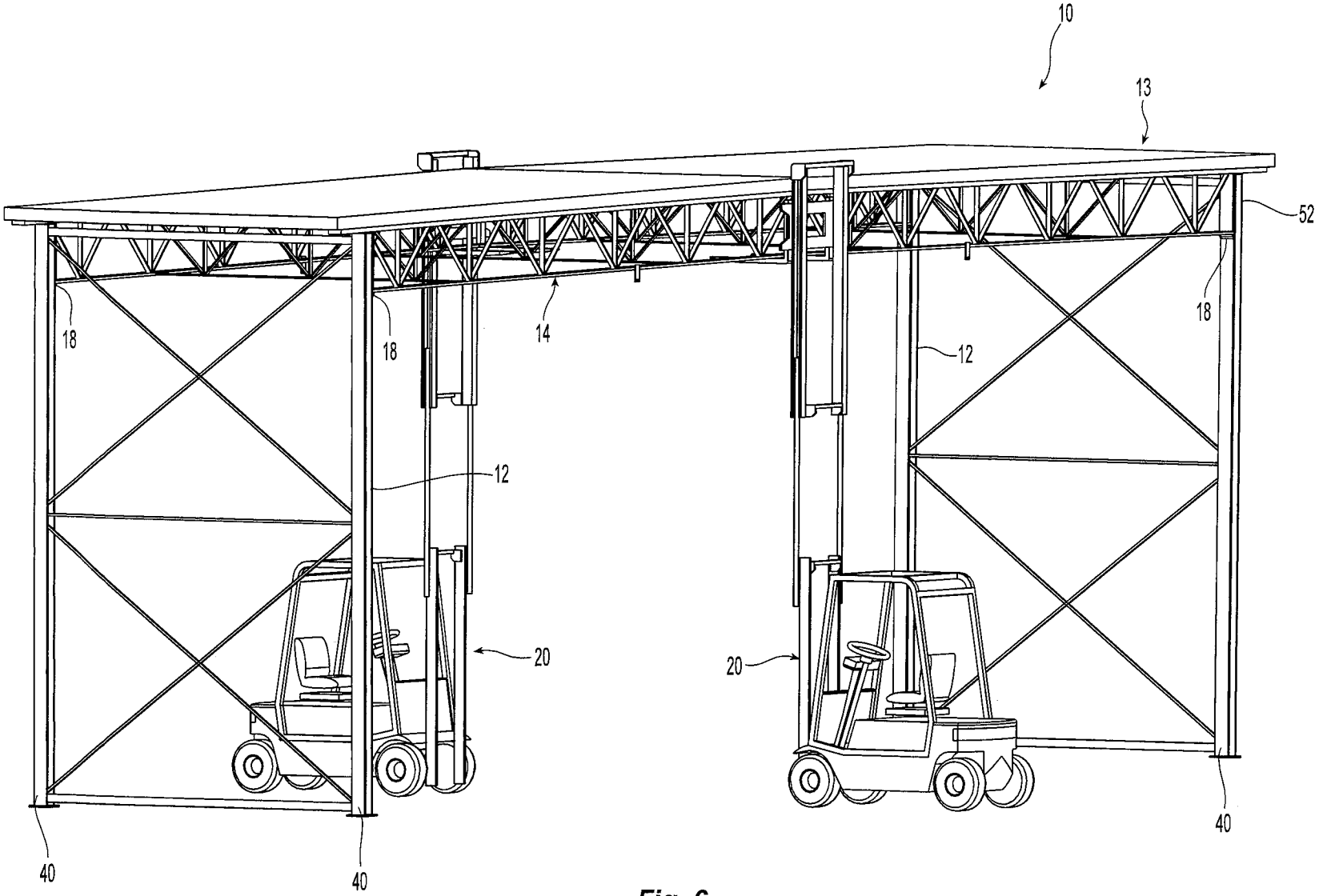

According to one exemplary construction method, building section 10 with its legs 12 secured in their stowed positions is maneuvered into a position generally over the eventual footprint of its installed position, and rested on the floor space. In this position, legs 12 are unsecured from their stowed positions and roof portion 13 then raised, causing legs 12 to swing downwardly under the influence of gravity. Referring to FIGS. 4-6, as the crane or forklifts 20 continue to raise the roof portion, legs 12 will continue to pivot downwardly under their own weight into their expanded positions and building section 10 will enter a building section expanded state in which legs 12 are generally vertically oriented. In its expanded state, building section 10 with the lower ends of both of its legs 12 still unretained to the construction site and therefore capable of unrestrained movement over the construction site, can be maneuvered into its installed position and its leg free ends 40 then secured to the construction site, whereby building section 10, and the modular clearspan building as erected on the construction site, are permanently affixed to the construction site and immovable. Because rafters 14 render roof portion 13 of building section 10 substantially rigid and perpetually maintain roof portion 13 in a roof portion extended condition, included angle θ of this embodiment has a fixed value in the range of 0° to 180°; hence, in building section 10 maximal and minimal values of included angle θ are identical to each other. Included angle θ of building section 10 is therefore at all times structurally constrained through rafters 14 of rigid roof portion 13 to not be less than its fixed, minimal value. In other words, included angle θ is at all times structurally prevented by rafters 14 from being less than its fixed, minimal value. Included angle θ is maintained at its fixed, minimal value in the installed state of building section 10 at the construction site, as best represented by FIG. 7. As noted above, in the installed state, a building section embodiment according to the present invention defines the roof and opposing walls of an immovable modular clearspan building erected on the construction site.

Figure 13:
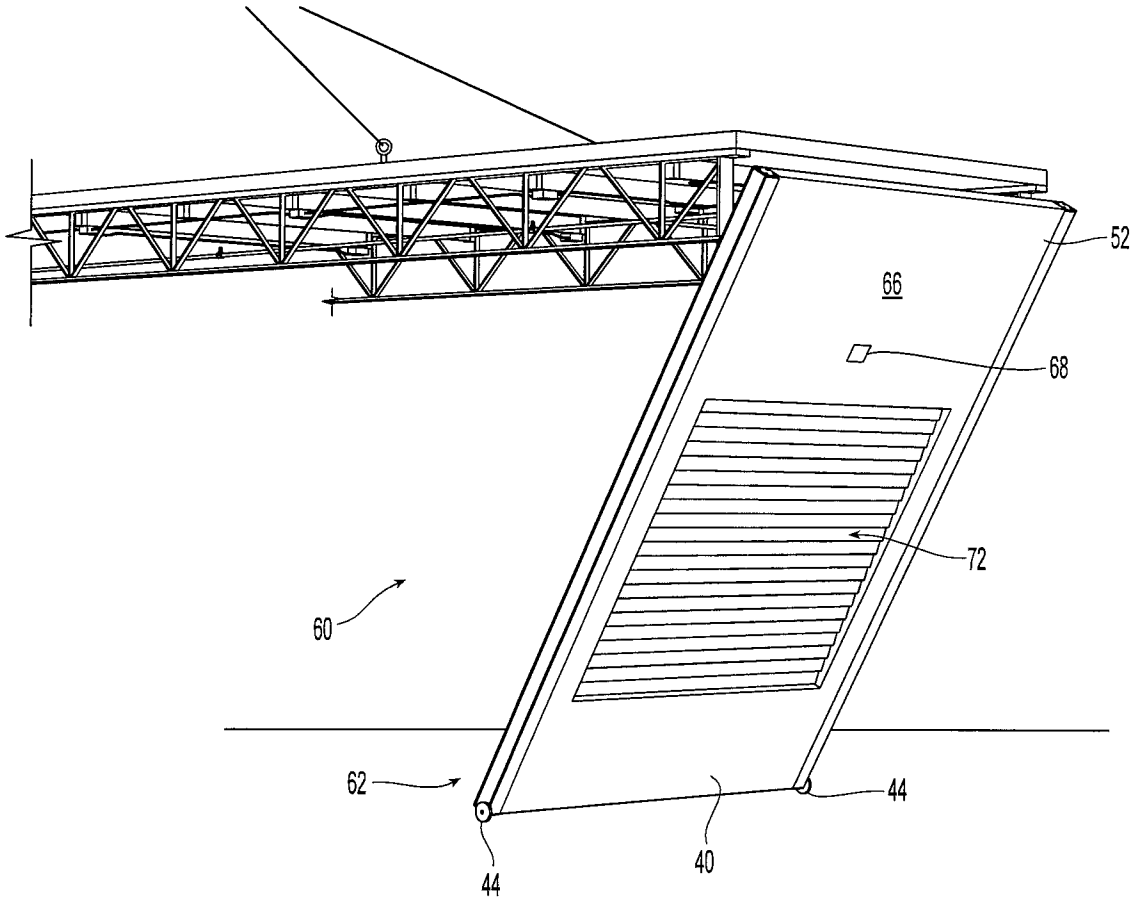
FIGS. 13 and 14 are side perspective views of a modular building section according to a third exemplary embodiment according to the present disclosure.
Figure 14:
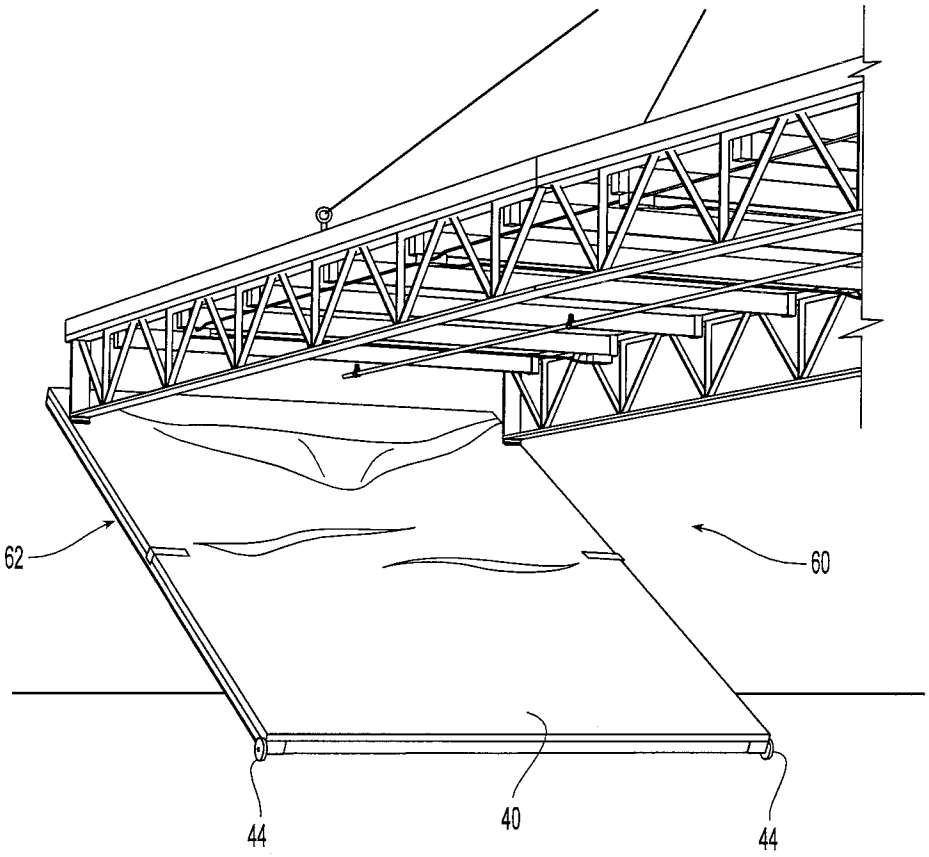
Figure 15:
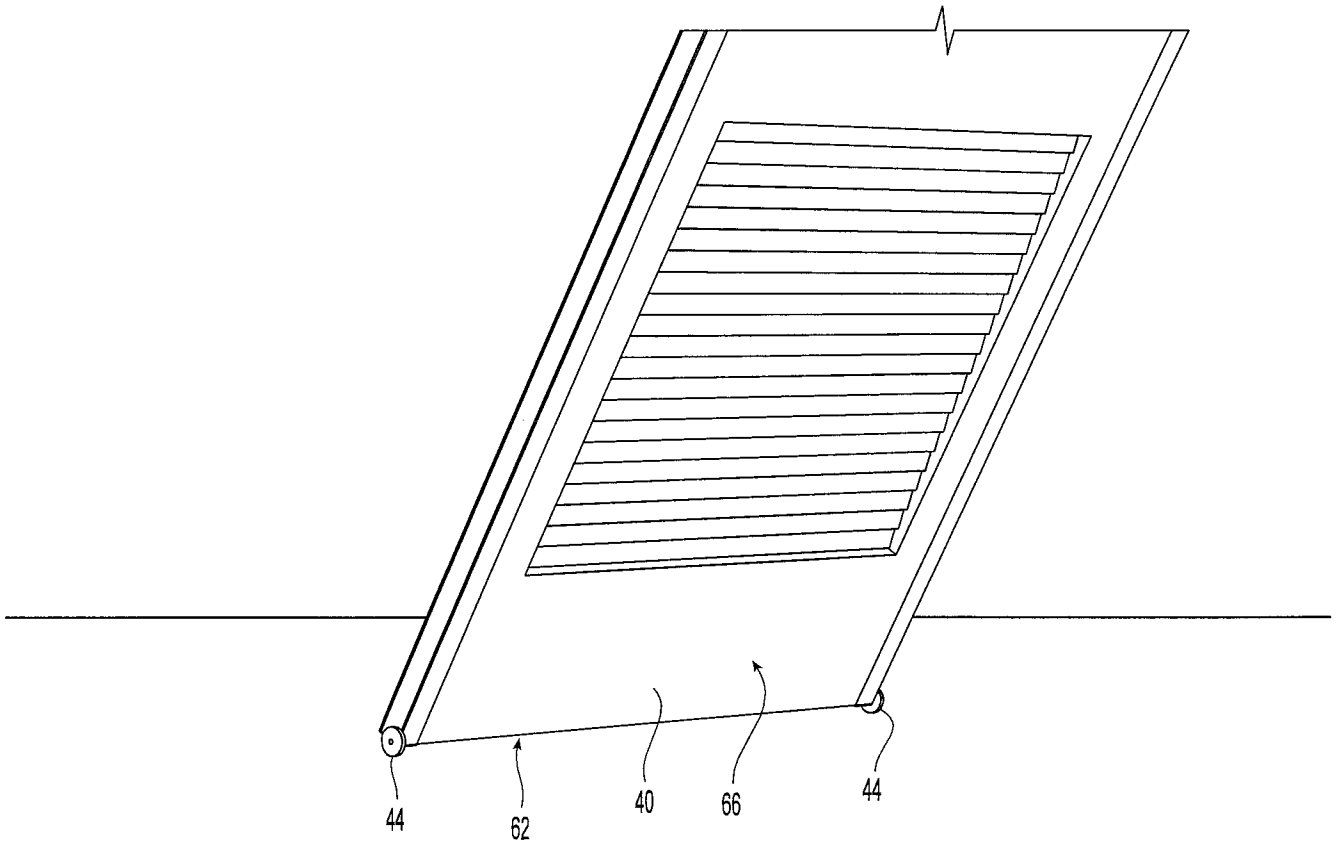
FIG. 15 is a side view of a portion of the modular building section shown in FIGS. 13 and 14.

In certain embodiments, wheels 44 (shown in FIGS. 13-15) are removably attached to free end 40 of each leg 12 at opposite lateral edges of the leg 12. At each leg's free end 40, the wheel's circumference extends beyond the leg's bottom edge and exterior side, thereby preventing damage to legs 12 that might otherwise occur by their free ends 40 being dragged along the ground or the concrete pad while the legs are being unfolded or building section 10 is being maneuvered in its expanded state. Wheels 44 may be installed at the factory prior to shipping building section 10, or installed at the construction site prior to unsecuring legs 12 from their stowed positions. Wheels 44 may be detached from legs 12 when placing building section 10 into its installed position.

Once the building section reaches the building section expanded state and its legs 12 are substantially vertical, the legs 12 may be secured to a building pad or other supporting structure. Legs 12 may thereafter be secured into their expanded positions, in which they are fixed relative to roof portion 13. Alternatively, legs 12 may first be fixed into their expanded positions, and leg free ends 40 thereafter placed and secured into their installed positions.

According to another construction method, building section 10, assuming its expanded state under the influence of gravity alone or with its legs 12 fixed into their fully expanded positions, is lifted by a crane and positioned generally above its eventual footprint on the construction site's building floor space, on which items to be housed by the building are located. By this construction method, removal of the items from the footprint, much less from the construction site, is unnecessary. Building section 10 is lowered into place over the items, and secured into its installed position as described above. In a variation of this construction method, building section 10, having assumed its expanded state under the influence of gravity or with its legs 12 fixed into their expanded positions, is supported by a crane above the floor space and moved laterally towards its installed position along the floor space and, in a straddling manner, over the items to be housed by the finished building. This variation of the construction method may be preferable when constructing a clearspan building having relatively tall walls or which is to house tall items, while the items to be housed remain on the building floor space.

Once moved into their respective installed positions, building sections 10 can be secured into the installed positions by bolting leg free ends 40 to spaced stanchions set into and projecting from the concrete pad whereby building sections 10, and the modular clearspan building as erected on the construction site, are permanently affixed to the construction site and immovable. Legs 12 of adjacently installed building sections 10 can also be bolted together through their abutting lateral edges.

Figure 8:
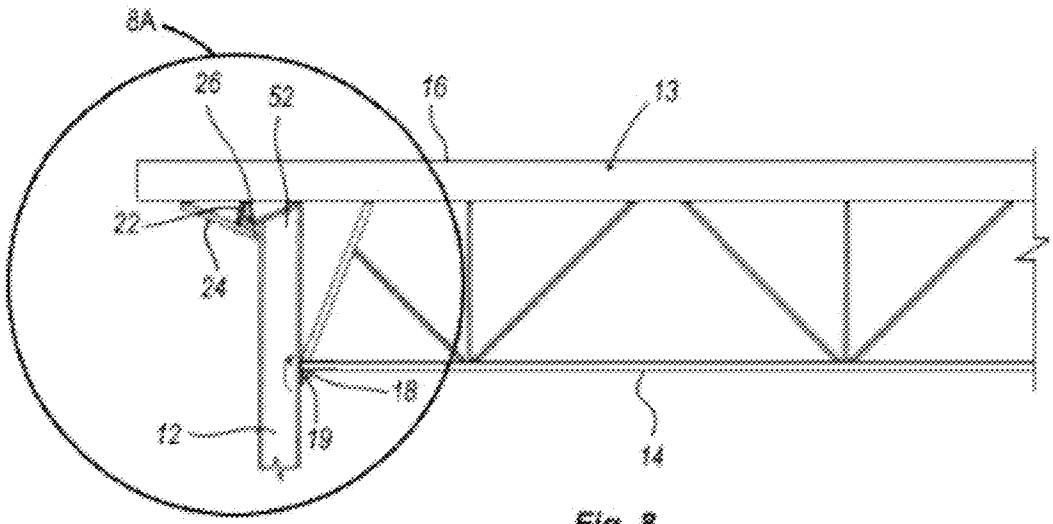
FIG. 8 is a schematic view of an exemplary embodiment of a locking mechanism having an expanding flange.
Figure 8A:
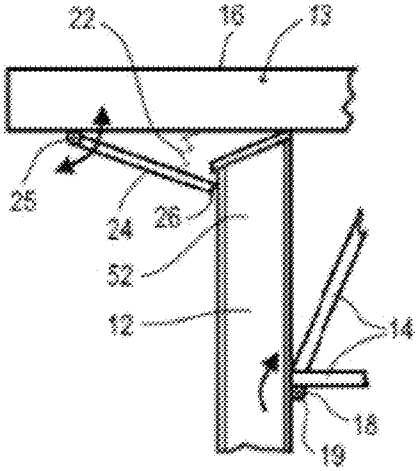
FIG. 8A is an enlarged, fragmented view of locking mechanism portions shown within imaginary circle 8A of FIG. 8.

In certain embodiments, one or more expanding flanges 24 is pivotably attached about its respective pivot axis 25 to roof portion 13. Expanding flange 24 pivotably attached to the roof portion 13 is used to lock each leg 12 at least partially if not fully into its expanded position and temporarily prevent the leg from closing (i.e., folding inwardly) until the building's plurality of building sections 10 is fully secured into their respective installed positions and to each other. In one such embodiment, shown schematically in FIGS. 8 and 8A, each expanding flange 24 is biased open to prevent its associated leg 12 from closing. Specifically, referring to FIGS. 8 and 8A, each expanding flange 24 is biased to an open position about its pivot axis 25 by a respective biasing mechanism 22. In certain embodiments, biasing mechanism 22 is a spring as shown. Biasing mechanism 22 may be secured to roof portion 13 to secure biasing mechanism 22 in position. Biasing mechanism 22 exerts a biasing force on its expanding flange 24 to force expanding flange 24 towards its open position, as indicated above.

In operation, as legs 12 pivot about pivot points 18, uppermost end 52 of each respective leg 12 contacts its associated expanding flange(s) 24. As the leg 12 continues to rotate about its pivot point 18, the weight-induced force exerted by leg 12 against the expanding flange(s) 24 overcomes the biasing force of biasing mechanism 22, depressing expanding flange(s) 24 in a direction toward roof 16 and allows leg 12 to pass by expanding flange free end(s) 26. Once leg 12 has passed by its expanding flange free end 26, biasing mechanism 22 forces expanding flange 24 from the depressed position back into the open position, shown in FIGS. 8 and 8A, thereby capturing leg 12 in a position that prevents its pivoting, closing movement about pivot axis 19. The interactions of expanding flange free ends 26 with leg upper ends 52 prevent legs 12 from moving toward their stowed positions and helps retain building structure 10 in or near its fully expanded state.

FIGS. 9-12 depict modular building section 30, a second building section embodiment according to the present disclosure. Building section 30 includes foldable legs 12 as described above and an articulable roof portion 46. Except as indicated otherwise, building section 30 is substantially similar in structure and function to, and is erected by the same techniques as, building section 10; identical reference numerals have been used to identify their substantially identical or similar, corresponding components. Roof portion 46 of each building section 30 includes rafters 36 and a pair of roof sections 32 whose respective portions of rafters 36, which are themselves individually substantially rigid, are pivotally connected to each another at pivot point 34, through which roof axis 48 extends in directions substantially parallel to pivot axes 19, whereby roof portion 46 is articulable about roof axis 48 rather than being a rigid structure. The exterior side of roof portion 46 defines roof 58 of building section 30. Roof 58 is supported by the pivotally interconnected portions of rafters 36 included the pair of roof sections 32 and, as shown in FIGS. 9-12, roof 58 continuously extends in longitudinal directions and across roof axis 48. Roof ridge 49 of building section 30 extends in directions along roof axis 48. A pair of opposing legs 12 is connected to the pair of rafter portions at pivot points 18, which are positioned along pivot axes 19 in a manner substantially similar to that described above with respect to building section 10.

Roof sections 32 of building section 30 are relatively moveable components of the articulable (i.e., non-rigid) roof portion 46, and cooperate to reconfigure building section 30 during construction of a clearspan building. In its installed state, and at times while building section 30 is being erected, roof portion 46 forms apex 50 (FIGS. 11 and 12) along roof ridge 49, from which the exterior side of each roof section 32 slopes downwardly along its length towards its eaves, which are located near legs 12. Rafters 36 include a pair of flanges 38. Each rafter flange 38 is located on a respective one of the pivotally interconnected pair of substantially rigid rafter portions, on opposite sides of roof axis 48. Each rafter flange 38 has an inwardly tapering slope. Creation of apex 50 is facilitated by bringing the pair of rafter flanges 38 into abutting contact with one another about roof axis 48 as shown in FIGS. 11 and 12.

Figure 9:
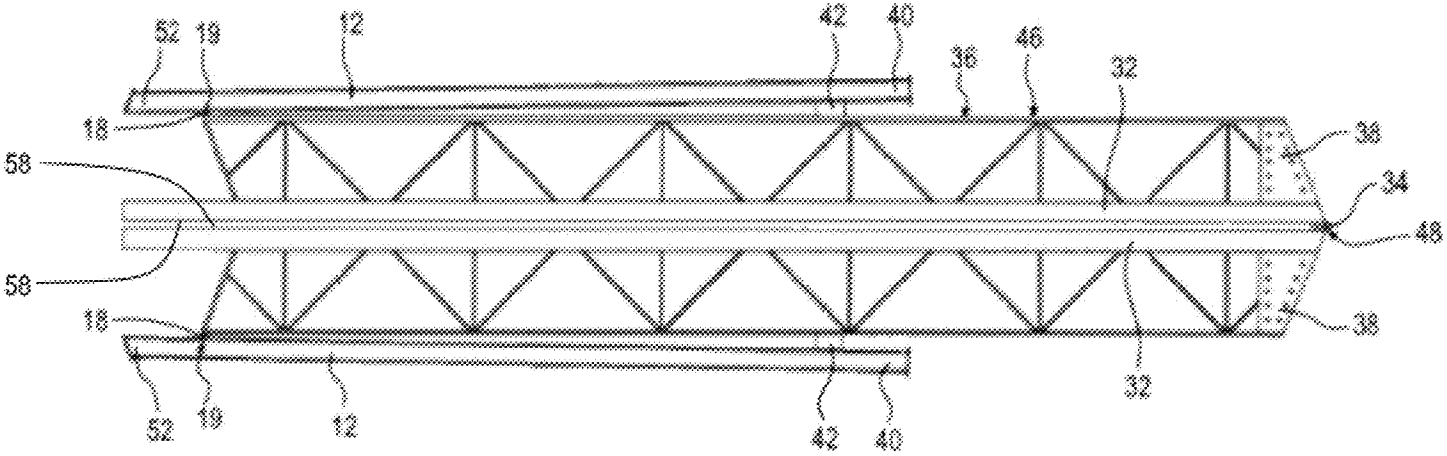
FIG. 9 is a side view of a modular building section according to a second exemplary embodiment according to the present disclosure having an articulable roof portion and shown in a folded configuration.
Figure 10:
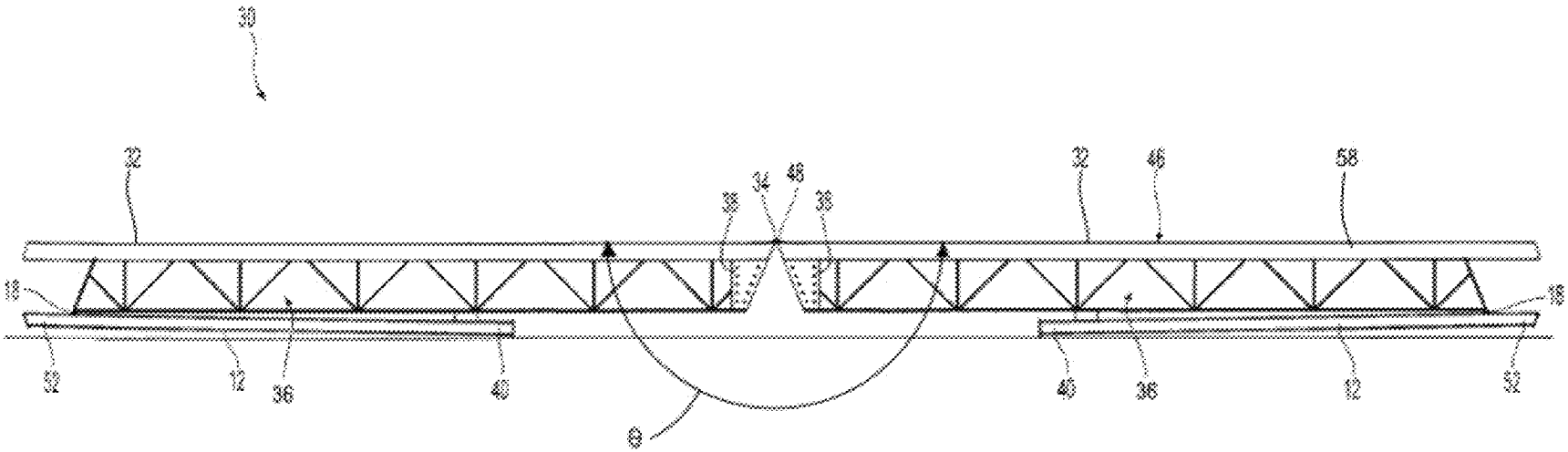
FIG. 10 is a side view of the modular building section of FIG. 9 shown in a roof portion extended condition in which its articulable roof portion is unfolded, and the legs are disposed beneath the roof portion.

As shown in FIG. 9, building section 30, with its legs 12 in their stowed positions, can be folded about pivot point 34 into a folded configuration that is about one-half the length of roof portion 46 as installed. This folded configuration better accommodates the transportation of relatively long building sections 30 on a tractor-trailer rig as described above with respect to building section 10. Alternatively, building section 30 can be transported in a configuration substantially as shown in FIG. 10. Once at a construction site, building section 30 is unloaded from the tractor-trailer rig and, if in its folded configuration, its roof sections 32 are unfolded to place the building section in the unfolded configuration substantially as shown in FIG. 10; i.e., roof sections 32 are unfolded by rotating them relative to each other about roof axis 48, such that the exterior sides of roof sections 32 both generally face upward and place legs 12 beneath roof portion 46, in which building section 30 is in a roof portion extended condition, with legs 12 still in their stowed positions. The distance between free end 40 of each leg 12 and its respective pivot axis 19 is no greater than the distance between that pivot axis 19 and the roof axis 48, so that legs 12 substantially lie in a plane when building section 30 is in the unfolded configuration shown in FIG. 10 and legs 12 are folded into their stowed positions. Thus, legs 12 may be longer than shown in FIGS. 9-12, resulting in an erected building of correspondingly greater height.

Figure 11:
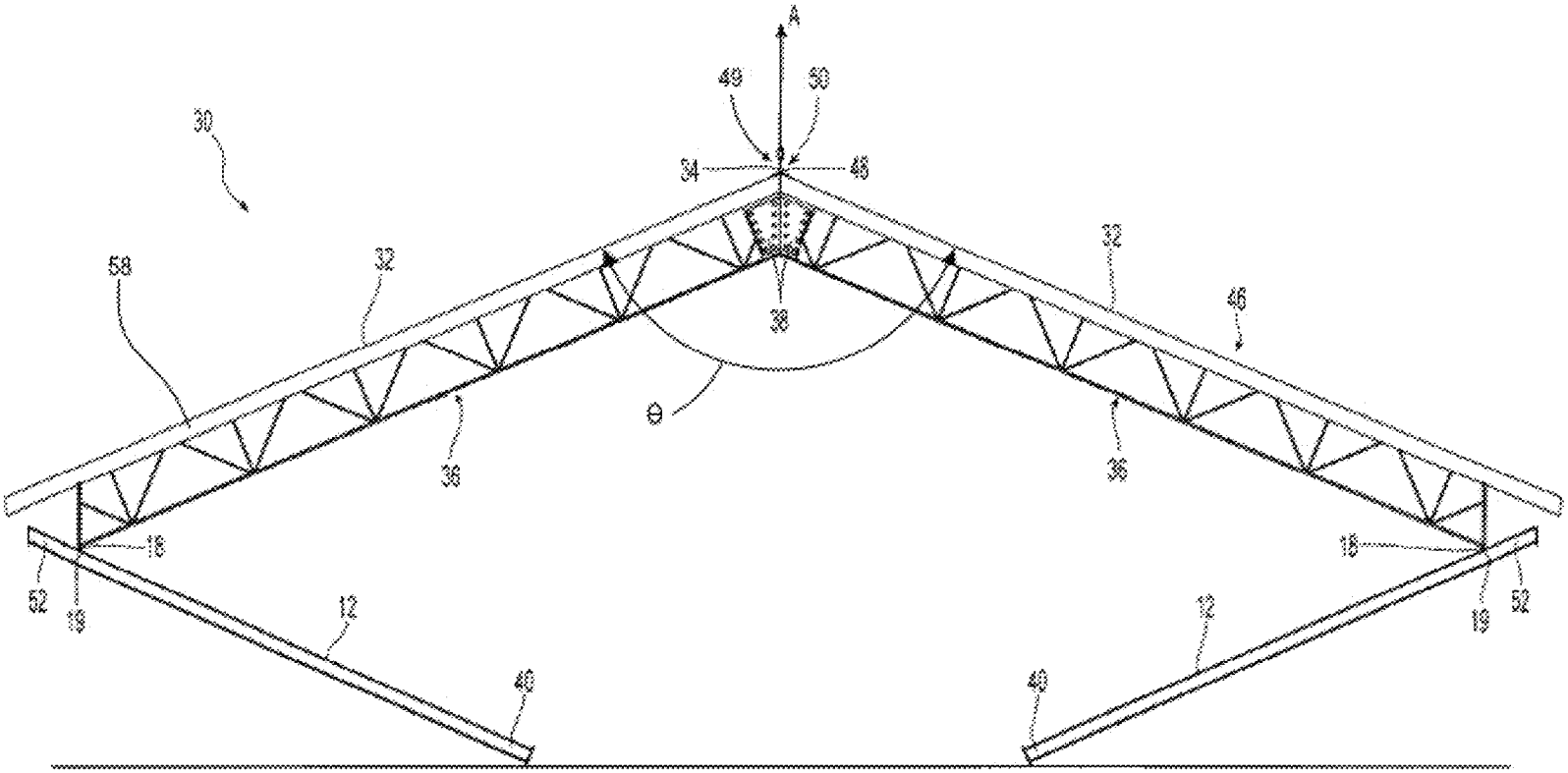
FIG. 11 is a side view of the building section of FIG. 9 as it is being elevated and partially erected, and approaching the building section expanded state.
Figure 12:
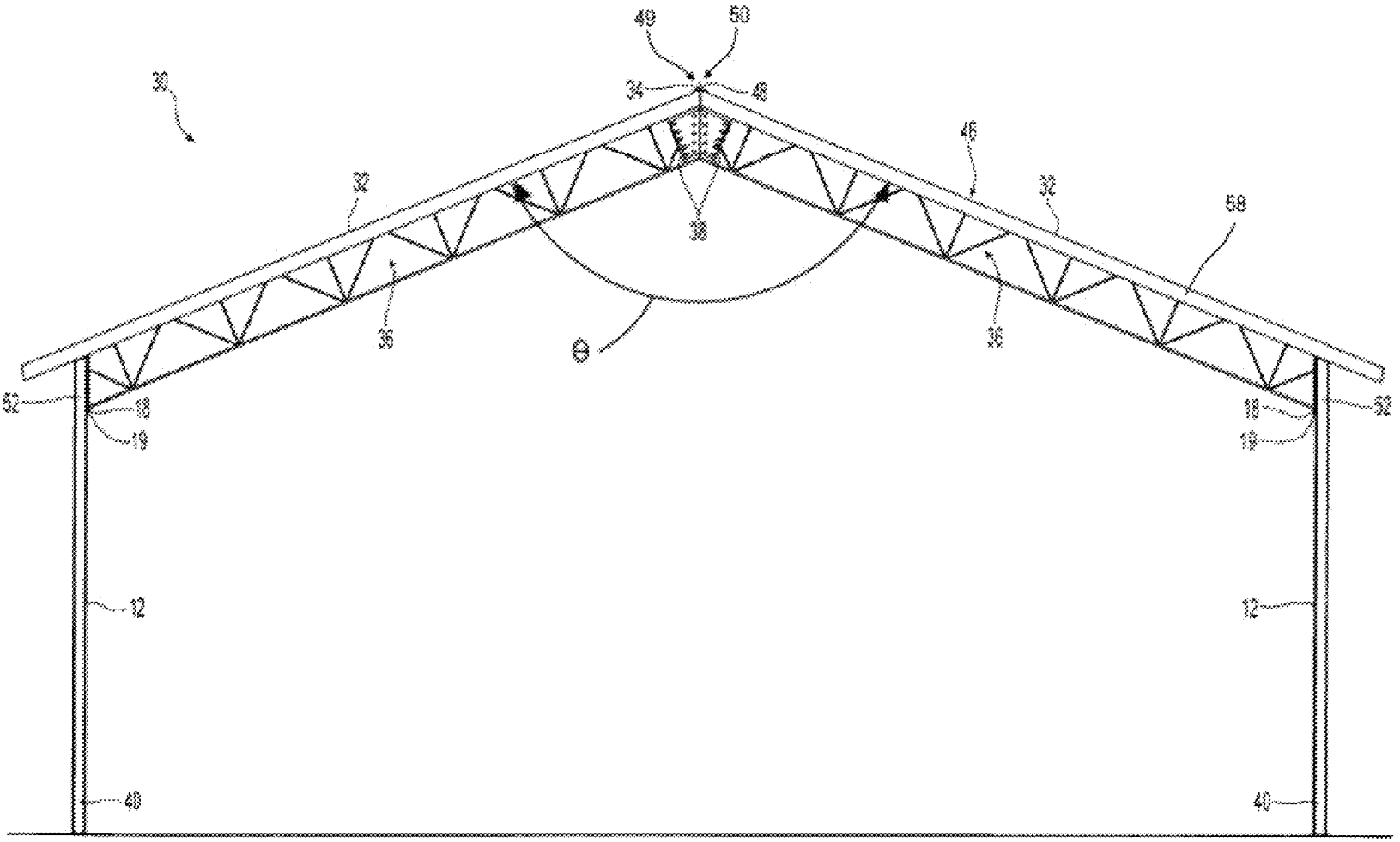
FIG. 12 is a side view of the building section of FIG. 9, showing the building section in its expanded state.

In building section 30, included angle θ of roof portion 46 extends about roof axis 48 and between spaced positions on pivotally interconnected roof sections 32 of roof portion 46, as best shown in FIGS. 11 and 12. Because roof portion 46 of building section 30 is articulable about roof axis 48, in the roof portion extended condition (in which legs 12 are disposed at all times beneath roof portion 46) included angle θ varies about roof axis 48 between a maximal value of included angle θ (generally as shown in FIG. 10) and a minimal value of included angle θ (generally as shown in FIGS. 11 and 12), both of which are in the range of 0° to 180°.

Transitioning from the view of FIG. 10 to that of FIG. 11, with the building section in its roof portion extended condition and legs 12 unsecured from their stowed positions, roof portion 46 is lifted near pivot point 34 in the direction of arrow A using a crane, for example. During lifting of roof portion 46, it is upwardly supported proximate roof axis 48, and in the roof portion extended condition the vertical position of roof axis 48, relative to the vertical positions of each of pivot axes 19, is highest prior to legs 12 being positioned in their respective fully expanded positions (see FIG. 12) or building section 30 being in its installed state, and in this highest relative vertical position of roof axis 48, pivotally connected roof sections 32 define roof portion apex 50 and roof ridge 49 that extends in directions along roof axis 48. Referring to FIG. 11, as roof portion 46 of building section 30 is raised, its opposing roof sections 32 will rotate downwardly about roof axis 48 until rafter flanges 38 are brought into abutting contact with one another. At this point, included angle θ reaches its minimal value, further relative pivoting motion between roof sections 32 is prevented while lifting roof portion 46, and roof apex 50 becomes fully defined. Hence, with building section 30 in its roof portion extended condition, the proximity between pivot points 18, and thus between their pivot axes 19, is limited solely by roof portion 46 irrespective of the positions of legs 12. As shown in FIGS. 10-12, in the roof portion extended condition of building section 30, the proximity between its axes 19 is determined solely by roof portion 46 at all leg positions; the proximity between axes 19 becoming limited during lifting of roof portion 46 upon abutment of rafter flanges 38 (FIGS. 11 and 12). Although one may choose to affix the abutting rafter flanges 38 to each other at this point, as by bolting them together, once roof portion 46 of building section 30 is moved into this configuration, in which included angle θ is at its minimal value, both roof sections 32 will rise as a single unit as roof portion 46 is lifted higher, and legs 12 will continue to rotate downwardly about pivot points 18 as described above with respect to building section 10, which is to say that during elevation of roof portion 46, its legs 12 move downwardly about pivot points 18 independently of each other from their respective stowed positions to their respective expanded positions under the influence of gravity as the roof portion is lifted, as seen in the progression shown in FIGS. 10 to 12, sequentially. As shown, the movements of legs 12 from their stowed positions to their expanded positions is accomplished with the lower end of neither leg 12 retained to the construction site. Consequently, as described above regarding building section 10, building section 30 is capable of unrestrained movement over the construction site with legs 12 in their expanded positions, and in its expanded state building section 30, with the lower ends of both of its legs 12 still unretained to the construction site and therefore capable of unrestrained movement over the construction site, can be maneuvered into its installed position and its leg free ends 40 then secured, whereby building section 30, and the modular clearspan building as erected on the construction site, are permanently affixed to the construction site and immovable.

Therefore, because roof portion 46 of building section 30 is articulable rather than being a rigid structure, in its extended condition included angle θ has differing values within its defining range, i.e., within the range of 0° to 180°. More particularly, in the depicted embodiment of building section 30, included angle θ about roof axis 48 ranges between a maximal value that, as depicted in FIG. 10, approximates a straight angle, and a minimal value that is reached by the abutment of rafter flanges 38 as depicted in FIGS. 11 and 12. Thus, included angle θ is at all times structurally constrained through rafters 36 of roof portion 46 to not be less than its minimal value. In other words, included angle θ is at all times structurally prevented by rafters 36 from being less than its minimal value. Included angle θ of building section 30 is maintained substantially at its minimal value with building section 30 secured into its installed position, best represented by FIG. 12.

In FIG. 12, building section 30 is shown in an expanded state with legs 12 in their fully expanded positions. In some embodiments of building section 30, expanding flanges 24 (described above with respect to building section 10) are used to maintain building section 30 partially if not in its fully expanded state. Moreover, as clearly shown in the embodiment depicted in FIGS. 10-12, with roof portion 46 disposed above both of legs 12, the proximity (i.e., nearness) of leg pivot axes 19 to each other is limited by roof portion 46 regardless of the positions of legs 12.

Figure 16:
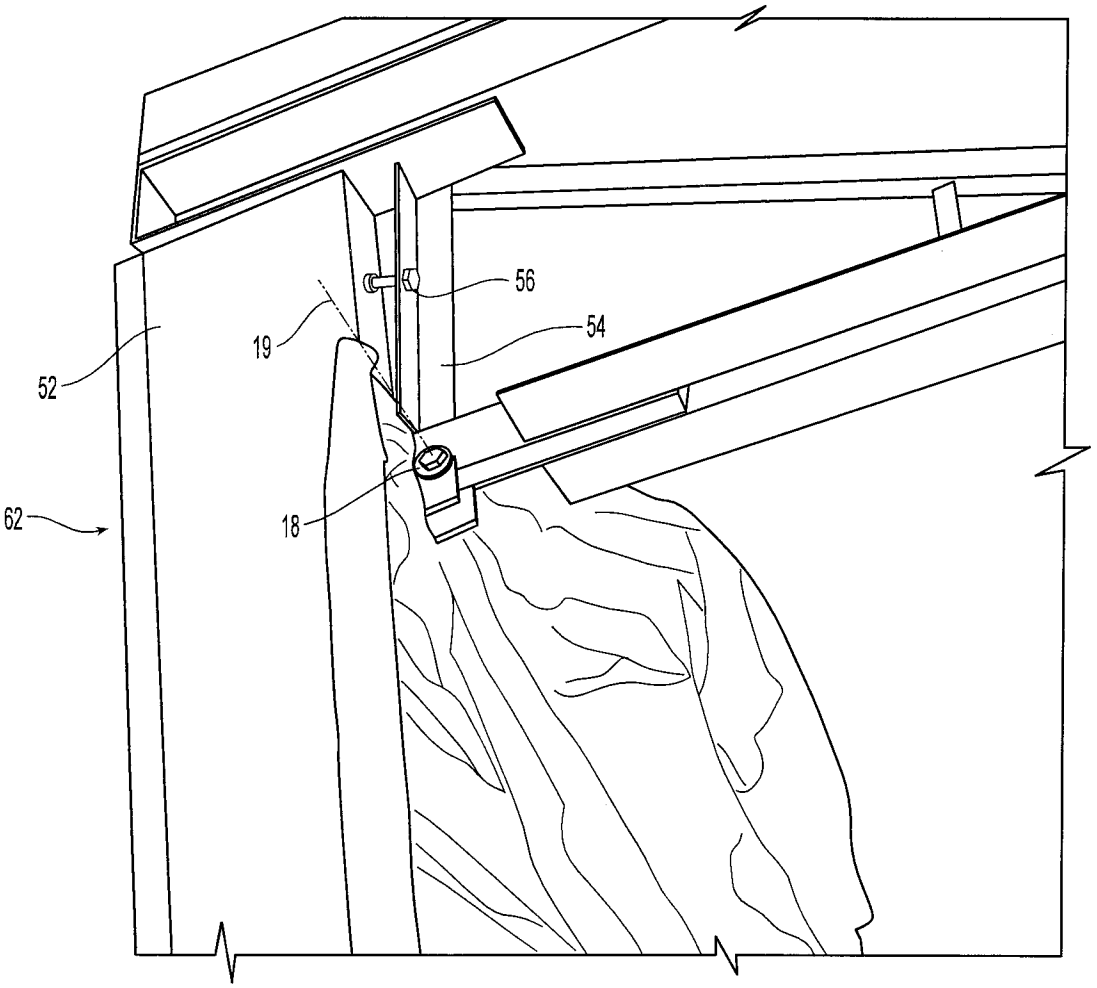
FIG. 16 is a lower side perspective view of the modular building section shown in FIGS. 13 and 14.
Figure 17:
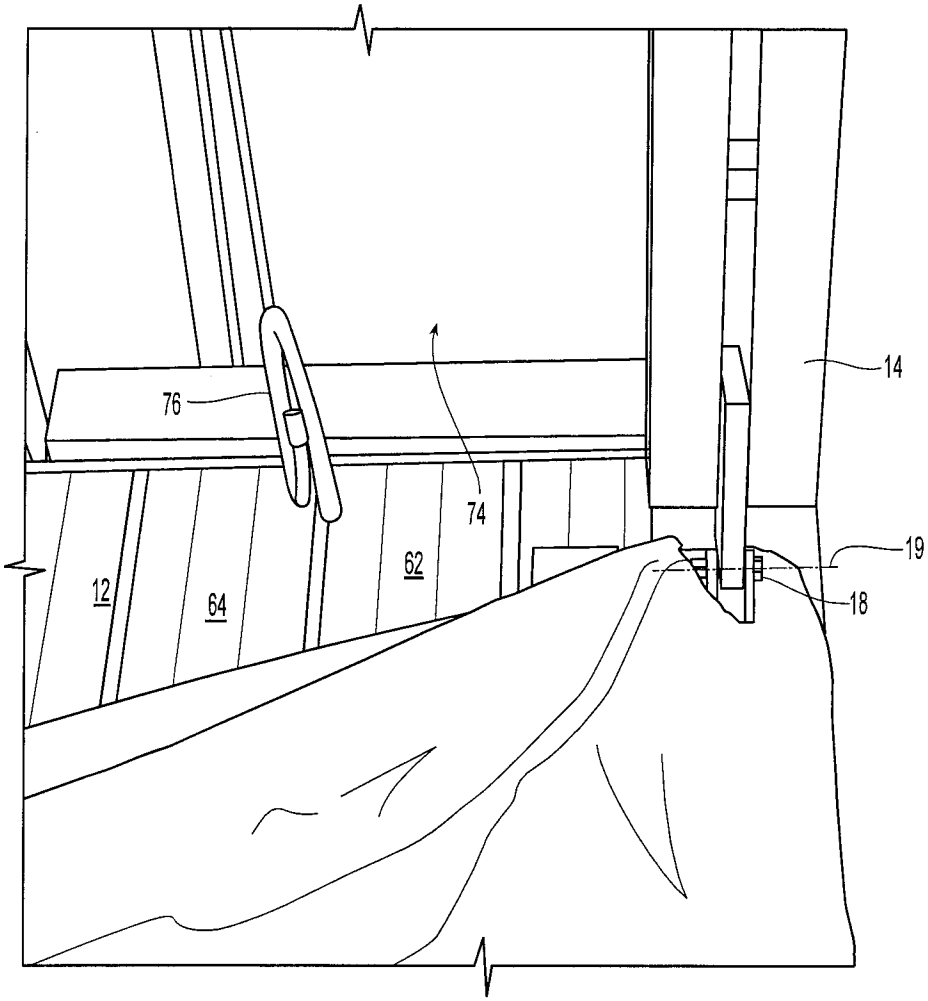
FIG. 17 is a lower interior perspective view of the modular building section shown in FIGS. 13 and 14.

Alternatively, or additionally, in some modular building section embodiments upper ends 52 of legs 12, located above pivot points 18, are bolted to rafter members 14, 54 to fully draw and securely fix legs 12 into their expanded positions, wherein the building section is in its fully expanded state. In such embodiments, interfacing surfaces of each leg's upper end 52 and a rafter member 14, 54 are drawn together into abutting contact and securely clamped together by tightening interconnecting bolts extending therethrough (e.g., bolts 56 of FIG. 16), thereby preventing their relative pivotal motion about pivot axes 19, and locking the legs 12 into their fully expanded positions.

Some modular building section embodiments according to the present disclosure are manufactured and shipped with legs 12 defining a skeleton or framework to which building walls may be attached during building construction. Examples of such embodiments are shown in FIGS. 1-12. The legs of such embodiments provide a wall-supporting structure, but are manufactured and shipped without walls, which are installed subsequent to installing the building sections.

Referring now to FIGS. 13-22, third embodiment building section 60 is manufactured and shipped to the construction site with a roof portion 74 providing a finished roof 16 substantially as described above and roof-supporting rafters 14. Building section 60 also includes a pair of foldable legs 12 as described above. Except as indicated otherwise, building section 60 is substantially similar in structure and function to, and is erected by the same techniques as, building section 10 and/or 30 as described further below; identical reference numerals have been used to identify their substantially identical or corresponding components.

Legs 12 of building section 60 as shipped and installed define substantially finished wall portions 62 of the clearspan building. Roof portion 74 and/or wall portion 62 in various embodiments of building section 60 include structural and operational features of the completed building. These features, which have a structural and/or operational purpose in the completed building, are installed during manufacture of modular building sections 60 at the factory, and are therefore installed concurrently with building sections 60, during construction of the resulting building.

Wall portions 62 of an embodiment of building section 60 are defined by interior siding 64 and exterior siding 66 located on opposite sides of legs 12. Wall portions 62 may be insulated, as by the provision of fiberglass batting or other suitable insulating material between interior and exterior siding 64, 66. As manufactured, building section 60 carries componentry of systems that include structural and/or operational features of the completed building. For example, building section 60 may include receptacles for part of an electrical system 68; pipes and/or fittings for part of a plumbing system, finished (e.g., painted) doors 72, and/or windows and their associated trim; and/or ducts and/or registers for part of an HVAC system, some of which are not shown.

Roof portion 74 of an embodiment of building section 60 may include features such as, for example: wiring, components (e.g., lighting components 80), fixtures and/or receptacles for part of an electrical system 76; pipes and/or fittings for part of a plumbing system 82; safety system components (e.g., smoke or CO detectors and wiring, and sprinkler system components 84); and/or ducts and/or components for part of an HVAC system, some of which are not shown.

Figure 18:
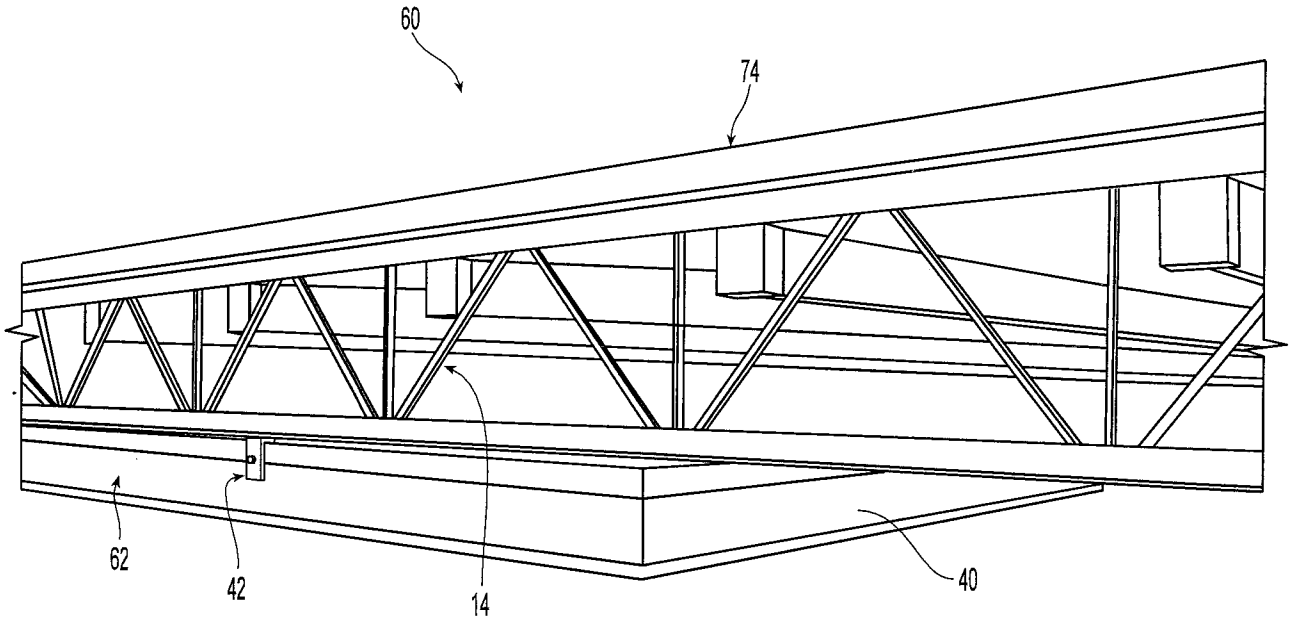
FIGS. 18 and 19 are views of the modular building section according to the third embodiment with legs in their stowed positions.
Figure 19:
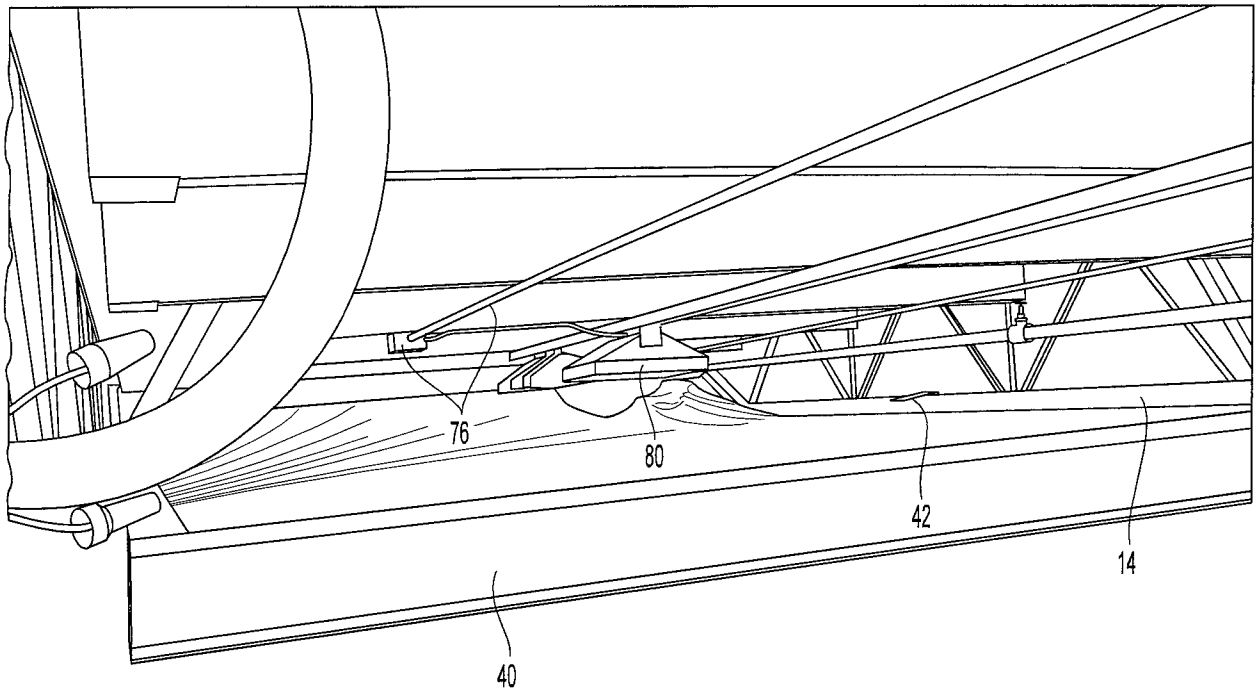
Figure 20:
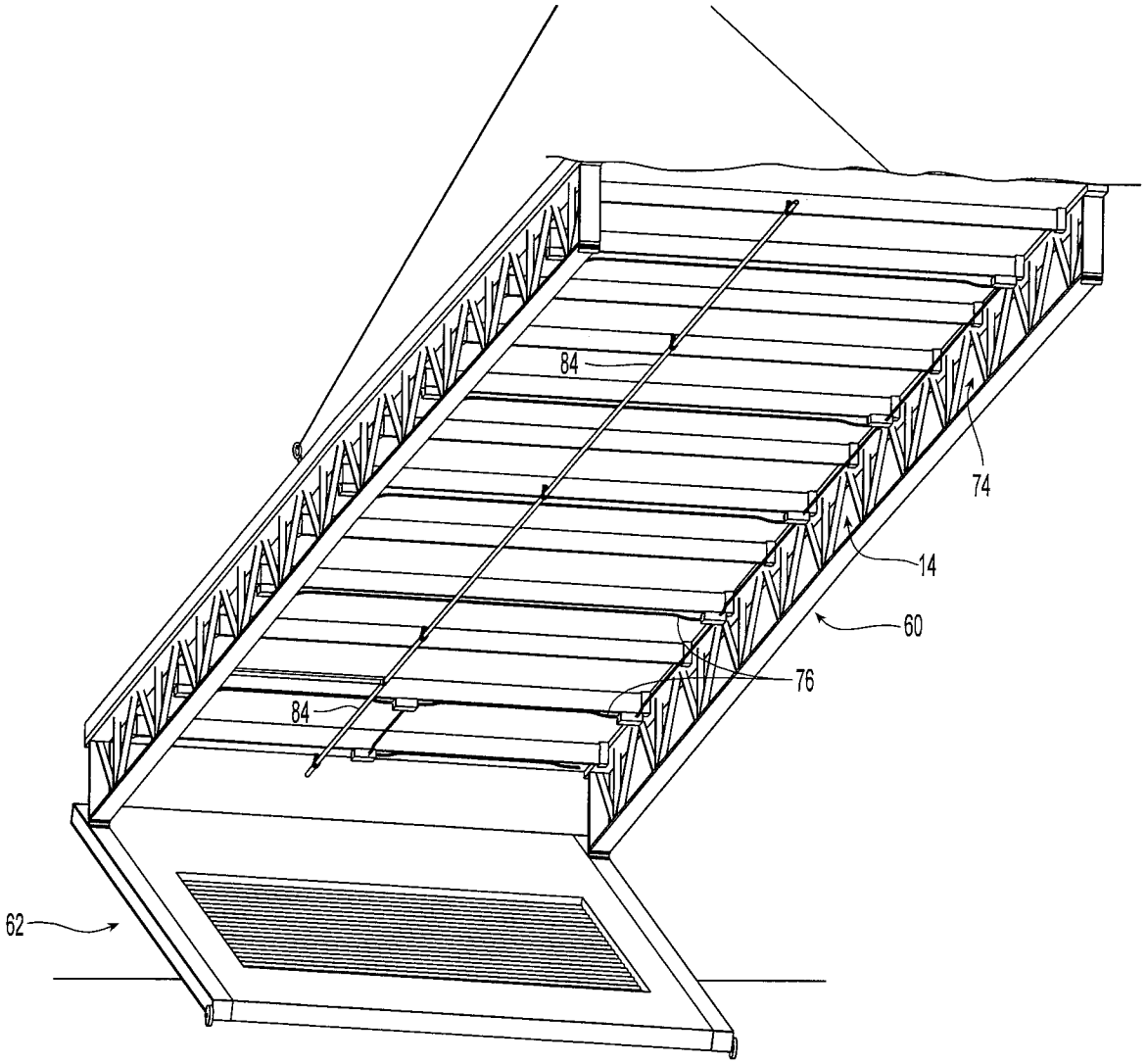
FIGS. 20-22 are interior perspective views of the modular building sections shown in FIGS. 17-19, showing included structural and operational features for a finished building.
Figure 21:
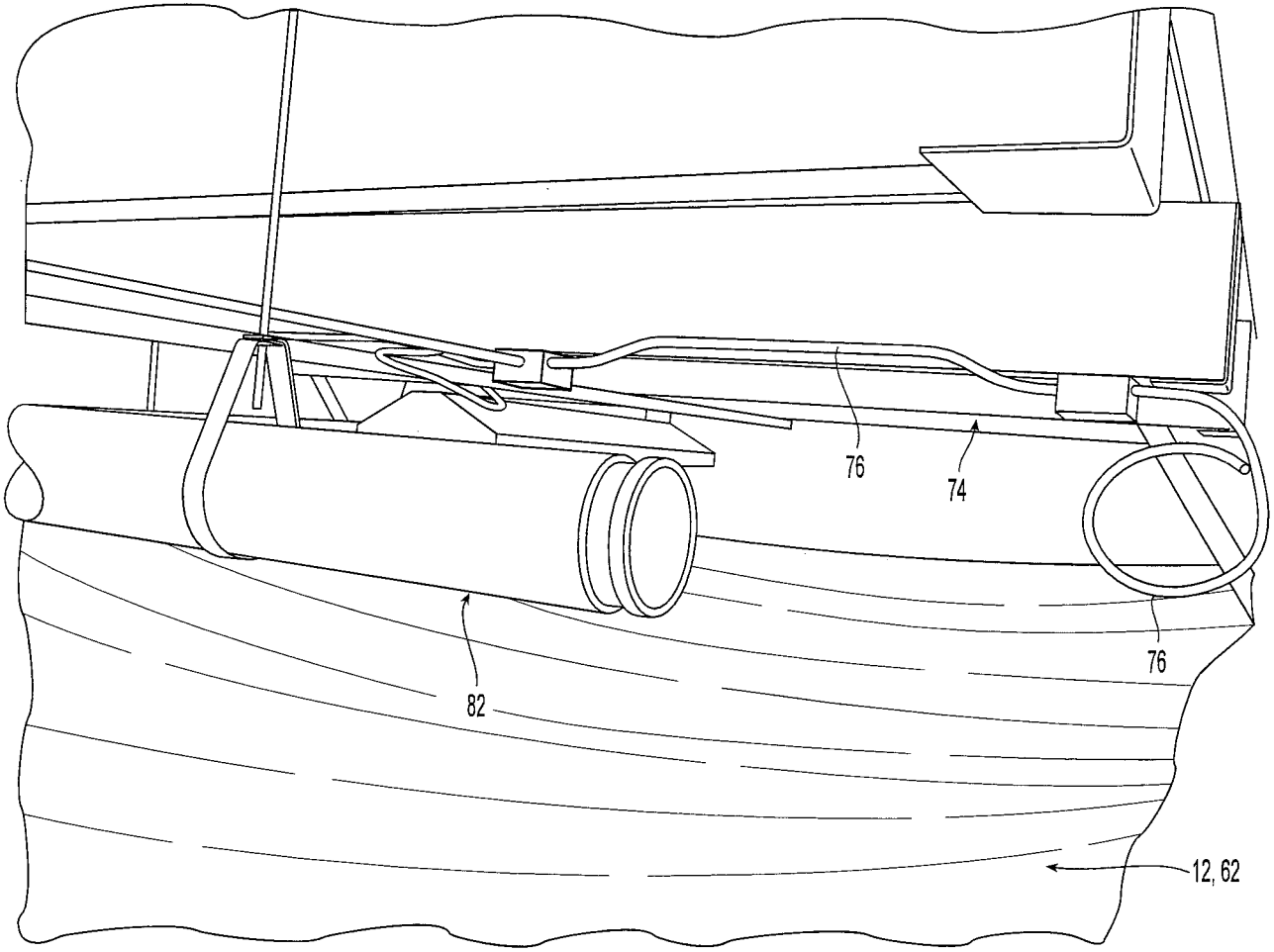
Figure 22:
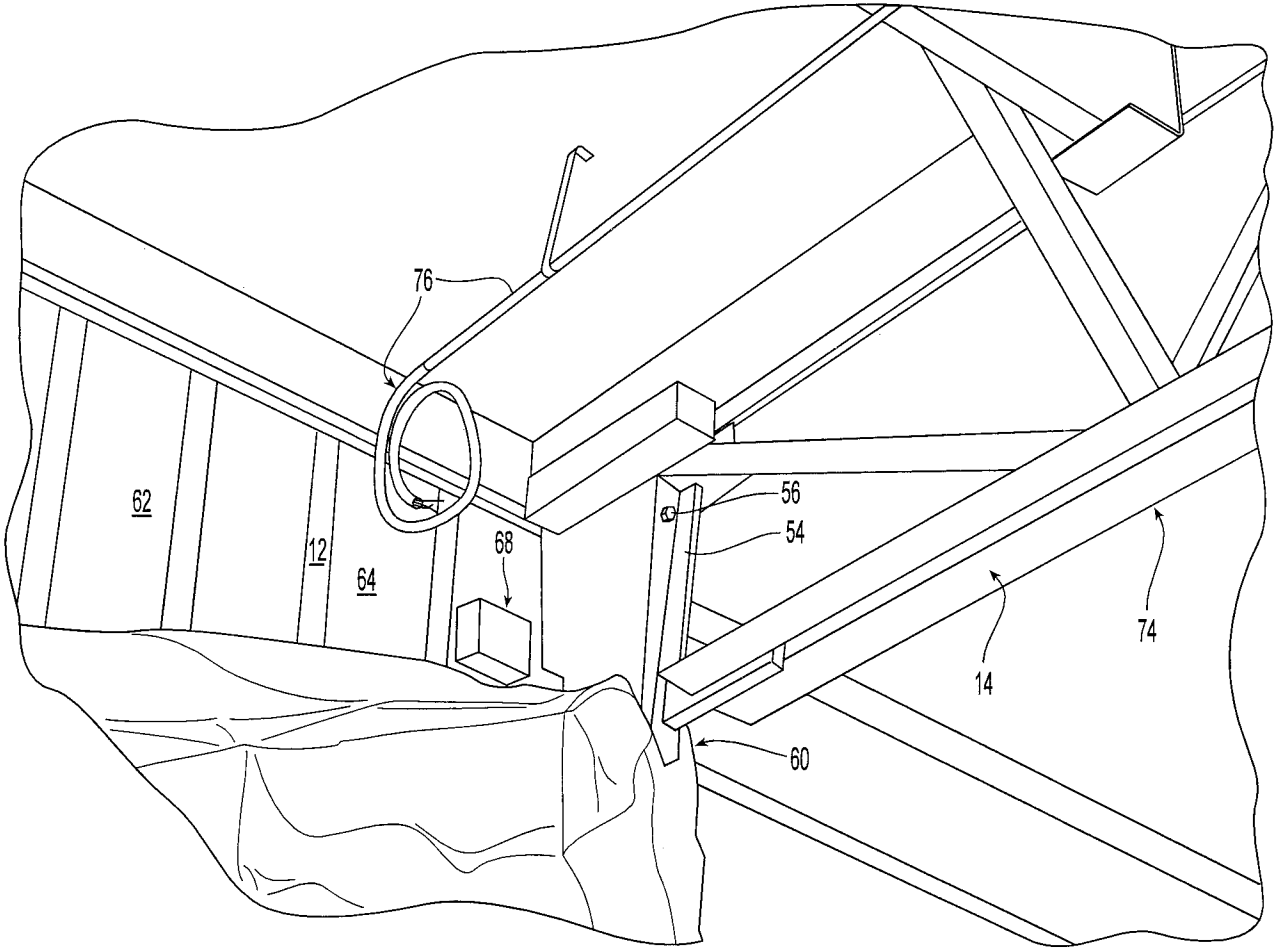

Referring to FIGS. 18 and 19, the structural and operational features incorporated into roof portion 74 and/or wall portion(s) 62 of embodiments of building section 60 are positioned between its vertically superposed roof and wall portion(s) when legs 12 are in their stowed positions, as during shipping. Features carried by roof and wall portions 74, 62 of an individual building section 60 that include part of certain operational systems for the building (e.g., electrical wiring) may be interconnected or placed in an interconnection-ready state during manufacture of the individual building section 60. Such embodiments of building section 60 can also facilitate the interconnections of certain system features between adjoining individual building sections 60 once they have been secured into their installed positions during construction of the building.

As earlier mentioned, building section 60 is erected in a manner similar to that described above in connection with building section 10 and/or building section 30. That is, during elevation of roof portion 74 of building section 60, legs 12 defining wall portions 62 move downwardly about pivot points 18 independently of each other from their respective stowed positions to their respective expanded positions under the influence of gravity as the roof portion is lifted, as described above with reference to the progressions shown sequentially in FIGS. 2 to 6 for building section 10 and/or FIGS. 10 to 12 for building section 30; and as in building sections 10 and 30, in building section 60, with its roof portion 74 disposed above both of its legs 12, the proximity (i.e., nearness) of leg pivot axes 19 to each other is limited by the roof portion regardless of the positions of the legs. As shown, the movements of legs 12 from their stowed positions to their expanded positions is accomplished with the lower end of neither leg 12 retained to the construction site. Consequently, as described above with regard to building section 10 and/or 30, building section 60 is capable of unrestrained movement over the construction site with legs 12 in their expanded positions, and in its expanded state building section 60 with the lower ends of both of its legs 12 still unretained to the construction site and therefore capable of unrestrained movement over the construction site, can be maneuvered into its installed position and its leg free ends 40 then secured whereby building section 60, and the modular clearspan building as erected on the construction site, are permanently affixed to the construction site and immovable.

According to each of the above-described embodiments, the open ends of the erected clearspan building, between which the installed building sections are located, are closed or capped with a plurality of adjacent, interconnected, vertically-extending, planar end wall sections (not shown) of known configuration, whose heights are typically greater than that of roof apex 50. These end wall sections may be finished with doors, siding, insulation, wiring, plumbing, and/or other componentry in situ, subsequent to their installation relative to building sections 10, 30, 60. Alternatively, such components may be installed during manufacture of the end wall sections, which are shipped to the construction site in a substantially finished condition, with their structural/operational components interconnected as necessary at the time of installation.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A modular building section, comprising:

an elongate roof portion comprising rafters that support a building section roof defined by an exterior side of the roof portion and extending in longitudinal directions between a first end of the roof portion and an opposite second end of the roof portion with the roof portion first end and the roof portion second end at all times interconnected through the roof portion, the roof portion having a roof axis across which the building section roof continuously extends in the longitudinal directions, said roof axis extending in directions substantially perpendicular to the longitudinal directions and located along the roof portion in the longitudinal directions centrally between the first end of the roof portion and the second end of the roof portion; and a first leg and a second leg at all times interconnected through the roof portion, each of the first leg and the second leg respectively having a length that extends between an upper end and a lower end of the respective first leg or second leg, the first leg pivotally attached about a first pivot axis to the roof portion proximate the roof portion first end, the second leg pivotally attached about a second pivot axis to the roof portion proximate the roof portion second end, the first pivot axis and the second pivot axis substantially parallel to each other and to said roof axis, and the respective distance directly between said roof axis and the first pivot axis or the second pivot axis is at all times fixed;

wherein said modular building section has a roof portion extended condition in which the first leg and the second leg are disposed beneath the roof portion, and said modular building section in the roof portion extended condition has an included angle defined as being within the range between 0° and 180°, the included angle extending about said roof axis and between a pair of positions that are located on the roof portion and spaced from each other in the longitudinal directions;

wherein the included angle has a maximal value and a minimal value, and the included angle minimal value is a constraint structurally imposed by the rafters;

wherein said modular building section has an installed state at a construction site in which the roof portion, and the first leg and the second leg, respectively define a roof and opposing walls of an immovable modular clearspan building as erected on and permanently affixed to the construction site, and in the installed state the included angle is maintained substantially at the minimal value;

wherein the first leg and the second leg each has a stowed position in which the length of the respective first leg or second leg extends generally in the longitudinal directions and the roof portion is in vertical superposition with the length of the respective first leg or second leg;

wherein each of the first leg and the second leg has an expanded position in which the length of the respective first leg or second leg depends from the roof portion and extends in generally vertical directions;

wherein, in the roof portion extended condition, the first leg and the second leg are moveable independently of each other from their respective stowed positions to their respective expanded positions under the influence of gravity during lifting of the roof portion relative to the lower end of the first leg and the lower end of the second leg with the lower end of the first leg and the lower end of the second leg each being unattached to the construction site;

wherein said modular building section has unrestrained movement over the construction site and into the installed state with the first leg and the second leg in their respective expanded positions and the included angle substantially at the minimal value; and wherein, in the roof portion extended condition, the proximity between the first pivot axis and the second pivot axis is limited solely by the roof portion rafters irrespective of the position of the first leg or the position of the second leg.

2. The modular building section of claim 1, wherein the roof portion is substantially rigid between said roof portion first end and said roof portion second end:

wherein the position of said roof axis, the position of the first pivot axis, and the position of the second pivot axis are at all times fixed relative to each other; and wherein the first leg and the second leg in their respective stowed positions are both disposed beneath the roof portion.

3. The modular building section of claim 1, wherein the first leg and the second leg in their respective stowed positions are substantially co-planar.

4. The modular building section of claim 1, wherein each of the first leg and the second leg has a free end at which the lower end of the respective first leg or second leg terminates; and wherein the distance between the first pivot axis or the second pivot axis and the free end of the respective first leg or second leg is less than one half the distance as measured along the roof portion in the longitudinal directions between the first pivot axis and the second pivot axis across said roof axis and along the roof portion in the longitudinal directions.

5. The modular building section of claim 1, wherein the roof portion is articulable between said roof portion first end and said roof portion second end, and said roof portion comprises a first roof section and a second roof section pivotally connected to each other about said roof axis;

wherein said modular building section is has a selective folded configuration in which the pivotally connected first roof section and the second roof section are vertically superposed and disposed vertically between the first leg and the second leg; and wherein, with the first leg and the second leg in their respective stowed positions, the length of said modular building section extending in the longitudinal directions in the folded configuration is shorter than the length of said modular building section extending in the longitudinal directions extends in the roof portion extended condition and said modular building section consequently occupies a relatively smaller area when in the folded configuration compared to when in the roof portion extended condition whereby accommodation of transportation or storage of said modular building section being in the folded configuration is improved relative to being in the roof portion extended condition.

6. The modular building section of claim 5, wherein during lifting of the roof portion, the roof portion is upwardly supported proximate said roof axis, and in the roof portion extended condition the vertical position of said roof axis, relative to the respective vertical positions of the first pivot axis and the second pivot axis, is highest prior to the first leg and the second leg being positioned fully in their respective expanded positions or said modular building section being in the installed state, and the pivotally connected roof sections define a roof portion apex and a roof ridge that extends in directions along said roof axis.

7. A modular clearspan building comprising at least one said modular building section according to claim 1 in the installed state.

8. The modular clearspan building of claim 7, wherein the at least one said modular building section has lateral edges, and the modular clearspan building comprises a plurality of laterally adjacent said modular building sections in the installed state, the plurality of said modular building sections interconnected along juxtaposed lateral edges thereof.

9. The modular building section of claim 1, wherein prior to said modular building section to being in the installed state each of the first leg and the second leg comprises substantially finished wall portions of a completed modular clearspan building.

10. The modular building section of claim 1, wherein said modular building section is manufactured and transportable to a construction site with the roof portion and the first leg and the second leg respectively defining substantially finished roof and wall portions of a completed modular clearspan building.

11. The modular building section of claim 10, wherein said modular building section as delivered to a construction site includes componentry attached to the roof portion and/or the first leg and/or the second leg selected from the group consisting of: interior siding, exterior siding, insulation, finished doors, windows, window trim, receptacles for part of an electrical system, wiring for part of an electrical system, fixtures for part of an electrical system, pipes for part of a plumbing system, fittings for part of a plumbing system, sprinkler system components, ducts for part of an HVAC system, registers for part of an HVAC system, and lighting system components; and wherein the selected componentry provides a completed modular clearspan building comprised of one or more of said modular building sections with features having structural and/or operational purposes in the completed modular clearspan building that are installed prior to delivery of said modular building section to the construction site.

12. The modular building section of claim 1, further comprising a pair of ground-engaging wheels at least temporarily attached to and supporting the respective lower ends of the first leg and the second leg during lifting of the roof portion, whereby dragging contact of the lower end of each of the first leg and second leg on the ground during lifting of the roof portion is prevented.

13. The modular building section of claim 1, wherein said modular building section is perpetually fixed in the roof portion extended condition with the included angle having a selfsame maximal value and minimal value.

14. A modular building section, comprising:

a roof portion extending in longitudinal directions between opposite first and second ends of the roof portion; and a pair of first and second legs, each of the first and second legs having a length that extends between an upper end and a lower end of the respective leg, the first leg pivotally attached about a first pivot axis to the roof portion proximate the roof portion first end, the second leg pivotally attached about a second pivot axis to the roof portion proximate the roof portion second end, the first and second pivot axes parallel to each other;

wherein said building section is configured to have an installed state at a construction site in which the roof portion and the pair of first and second legs respectively define the roof and opposing walls of an immovable modular clearspan building as erected on and permanently affixed to the construction site;

wherein each of the first and second legs has a stowed position in which the respective first or second leg length extends generally in the longitudinal directions and the roof portion is in vertical superposition with the respective first or second leg length, and each of the first and second legs has an expanded position in which the respective first or second leg length depends from the roof portion and extends generally perpendicularly to the longitudinal directions;

wherein, with the first and second legs in their respective stowed positions and expanded positions, the opposite first and second ends of the roof portion are interconnected through the roof portion; and wherein the first and second legs are moveable independently of each other from their respective stowed positions to their respective expanded positions under the influence of gravity during lifting of the roof portion with neither the lower end of the first leg nor the lower end of the second leg retained to the construction site, and the building section is capable of unrestrained movement relative to the construction site with the first and second legs in their expanded positions;

wherein the building section has a collapsed state in which the first and second legs are in their stowed positions and an expanded state in which the first and second legs are in their expanded positions;

wherein the building section further comprises a pair of expanding flanges, each of the pair of expanding flanges disposed proximate to either the roof portion first end or the roof portion second end, and wherein the roof portion and the respective first or second leg are engageable through one of the pair of expanding flanges;

wherein each expanding flange has an open position in which the respective first or second leg in its expanded position is retained in a substantially fixed orientation relative to the roof portion about the respective first or second pivot axis and movement of the respective first or second leg from its substantially fixed orientation is prevented through abutting engagement thereof with the expanding flange whereby, with both of the pair of expanding flanges in their open positions the building section is retained in the expanded state; and wherein each expanding flange is biased into its open position and is moveable from its open position into a depressed position through sliding engagement between the expanding flange and the respective first or second leg, wherein movement of the respective first or second leg from its stowed position into its expanded position is permitted in the expanding flange depressed position, whereby the building section is movable from its collapsed state into the expanded state.

15. The modular building section of claim 14, wherein each expanding flange is pivotally connected to the roof portion, and is abuttingly engageable and slidingly engageable with the respective first or second leg.

16. The modular building section of claim 15, wherein each expanding flange has a free edge abuttingly engageable with the respective first or second leg in the leg expanded position.

17. The modular building section of claim 15, wherein each first or second leg is pivotally attached to the roof portion at a location between the leg upper and lower ends; and wherein the expanding flange abuttingly engages a portion of the respective first or second leg between the leg upper end and the pivot axis.

18. The modular building section of claim 14, wherein with the building section in an expanded state each of the first leg and the second leg has a fully expanded position into which the first or second leg is secured relative to the roof portion.

* * * * *